US010710373B2

(12) United States Patent
Osakabe et al.

(10) Patent No.: US 10,710,373 B2
(45) **Date of Patent: *Jul. 14, 2020**

(54) SUPPLY APPARATUS

(71) Applicant: BROTHER KOGYO KABUSHIKI KAISHA, Nagoya-shi, Aichi-ken (JP)

(72) Inventors: Yoshinori Osakabe, Seto (JP); Masako Kawagoe, Nagoya (JP); Masahiro Hayashi, Nagoya (JP); Taichi Shirono, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/298,305

(22) Filed: Mar. 11, 2019

(65) Prior Publication Data

US 2019/0270312 A1 Sep. 5, 2019

Related U.S. Application Data

(63) Continuation of application No. 15/883,554, filed on Jan. 30, 2018, now Pat. No. 10,226,932.

(30) Foreign Application Priority Data

Jan. 31, 2017 (JP) ..... 2017-016366

(51) Int. Cl.
*B41J 2/175* (2006.01)
*B41J 2/145* (2006.01)
*B41J 29/13* (2006.01)

(52) U.S. Cl.
CPC ..... *B41J 2/17513* (2013.01); *B41J 2/145* (2013.01); *B41J 2/1752* (2013.01);
(Continued)

(58) Field of Classification Search
CPC ..... B41J 2/145; B41J 2/175; B41J 2/17509; B41J 2/17513; B41J 2/1752; B41J 2/17523; B41J 2/17553; B41J 2/17566; B41J 29/13
See application file for complete search history.

(56) References Cited

U.S. PATENT DOCUMENTS 5,777,646 A * 7/1998 Barinaga ..... B41J 2/17513 347/86
6,378,971 B1 * 4/2002 Tamura ..... B41J 2/175 347/7

(Continued)

FOREIGN PATENT DOCUMENTS

JP 2012-51306 A 3/2012
JP 5429425 B2 2/2014

(Continued)

*Primary Examiner* — Anh T Vo
(74) *Attorney, Agent, or Firm* — Merchant & Gould P.C.

(57) ABSTRACT

A supply apparatus includes: tanks; a binder which holds the tanks in a state of being arranged in a first direction; a casing which supports the binder; and a positioning part disposed between adjacent two tanks, the positioning part positioning the two tanks at an interval in the first direction. Each tank includes two side walls facing the first direction to define a liquid storage chamber and an inlet to supply liquid to the liquid storage chamber. The two side walls include portions formed from resin. At least one of the two side walls includes a portion formed from a film. The positioning part is in contact with: the portion formed from the resin of one of the two side walls of one of the two tanks; and the portion formed from the resin of one of the two side walls of the other of the two tanks.

4 Claims, 16 Drawing Sheets

(52) U.S. Cl.
CPC ..... *B41J 2/17509* (2013.01); *B41J 2/17523* (2013.01); *B41J 2/17553* (2013.01); *B41J 2/17566* (2013.01); *B41J 29/13* (2013.01)

(56) References Cited

U.S. PATENT DOCUMENTS

| | | | | |
|---|---|---|---|---|
| 9,126,414 | B2 | 9/2015 | Iwamuro et al. | |
| 10,226,932 | B2 * | 3/2019 | Osakabe | B41J 2/17523 |
| 2005/0134636 | A1 | 6/2005 | Matsuba et al. | |
| 2012/0056938 | A1 | 3/2012 | Ishizawa et al. | |
| 2014/0132678 | A1 | 5/2014 | Iwamuro et al. | |
| 2018/0281432 | A1 | 10/2018 | Kanaya et al. | |

FOREIGN PATENT DOCUMENTS

| | | | |
|---|---|---|---|
| JP | 5621902 | B2 | 11/2014 |
| JP | 2015-27807 | A | 2/2015 |

* cited by examiner

SUPPLY APPARATUS

CROSS REFERENCE TO RELATED APPLICATION

The present application is a continuation of U.S. patent application Ser. No. 15/883,554 filed on Jan. 30, 2018, which claims priority from Japanese Patent Application No. 2017-016366 filed on Jan. 31, 2017, the disclosure of which is incorporated herein by reference in its entirety.

BACKGROUND

Field of the Invention

The present invention relates to a supply apparatus which includes tanks that can be replenished with liquid via inlets.

Description of the Related Art

There is known a printer that includes: tanks that can be replenished with ink; and a recording head that records an image on a sheet by discharging, from nozzles, the ink supplied from the tanks. When the ink in each of the tanks is consumed, a user can replenish with ink stored in a bottle, from an inlet provided in the tank.

SUMMARY

When each of the tanks is installed in the printer, each of the tanks is misaligned at least by tolerance. Thereupon, when the tanks are installed in the printer, a maximum value of misalignment will be a value of tolerance of each of the tanks multiplied by the number of tanks.

The above-described misalignment can be reduced by installing the tanks in the printer as a tank unit in a state that the tanks are aligned without gaps therebetween. As a result, the misalignment can be suppressed to a value of the tolerance of the tank unit.

However, when each of the tanks is configured such that a film is attached to a side surface facing the adjacent tank, and when the tanks are installed in the printer in a state that the tanks are aligned without gaps therebetween, the film could be damaged by making contact with the adjacent tank. Especially, when the films are attached to both side surfaces of the tank, the films are more likely to be damaged.

Thus, a binder may be used to integrate the tanks such that the tanks are arranged with gaps, and the tanks in an integrated state may be installed in the printer.

In that case, the tanks integrated by the binder have backlash between themselves and the binder caused at least by tolerance of the tanks. This backlash could cause a film of one of the two tanks that are arranged adjacent to each other while leaving a gap, to make contact with a film or flame of the other tank, thus damaging the film(s).

The present teaching has been made in view of the above circumstances, and an object of the present teaching is to provide a supply apparatus in which tanks having side surfaces, to which films are attached, are arranged adjacent to each other at intervals.

According to an aspect of the present teaching, there is provided a supply apparatus, including: tanks; a binder configured to hold the tanks in a state of being arranged in a first direction along a horizontal direction; a casing configured to support the binder; and a positioning part disposed between two tanks, of the tanks, disposed adjacent to each other, and the positioning part being configured to position the two tanks at an interval in the first direction, wherein each of the tanks includes two side walls facing the first direction to define a liquid storage chamber and an inlet through which liquid is supplied to the liquid storage chamber, the two side walls include portions formed from resin, at least one of the two side walls includes a portion formed from a film which is more flexible than the resin, and the positioning part is in contact with: the portion formed from the resin of one of the two side walls of one of the two tanks; and the portion formed from the resin of one of the two side walls of the other of the two tanks.

In the above configuration, the positioning part is positioned between the two adjacent tanks. The positioning part is in contact with: one of the two side walls, of one of the two tanks, which is close to the other of the two tanks; and one of the two side walls, of the other of the two tanks, which is close to the one of the two tanks. This allows the two adjacent tanks to be held at an interval formed by the positioning part.

The positioning part is in contact with: the portion formed from the resin of one of the two side walls of one of the two tanks; and the portion formed from the resin of one of the two side walls of the other of the two tanks. This prevents the portion formed from the film of at least one of the two side walls from being damaged which may otherwise be caused by the contact with the positioning part.

According to the present teaching, when tanks having side surfaces, to which films are attached, are disposed adjacent to each other, two adjacent tanks, of the tanks, can be arranged at an interval.

BRIEF DESCRIPTION OF THE DRAWINGS

FIGS. 1A and 1B are perspective views each depicting an external appearance of a multifunctional peripheral, wherein FIG. 1A depicts a state in which a cover is closed and FIG. 1B depicts a state in which the cover is open.

DESCRIPTION OF THE EMBODIMENTS

Figure 1A:
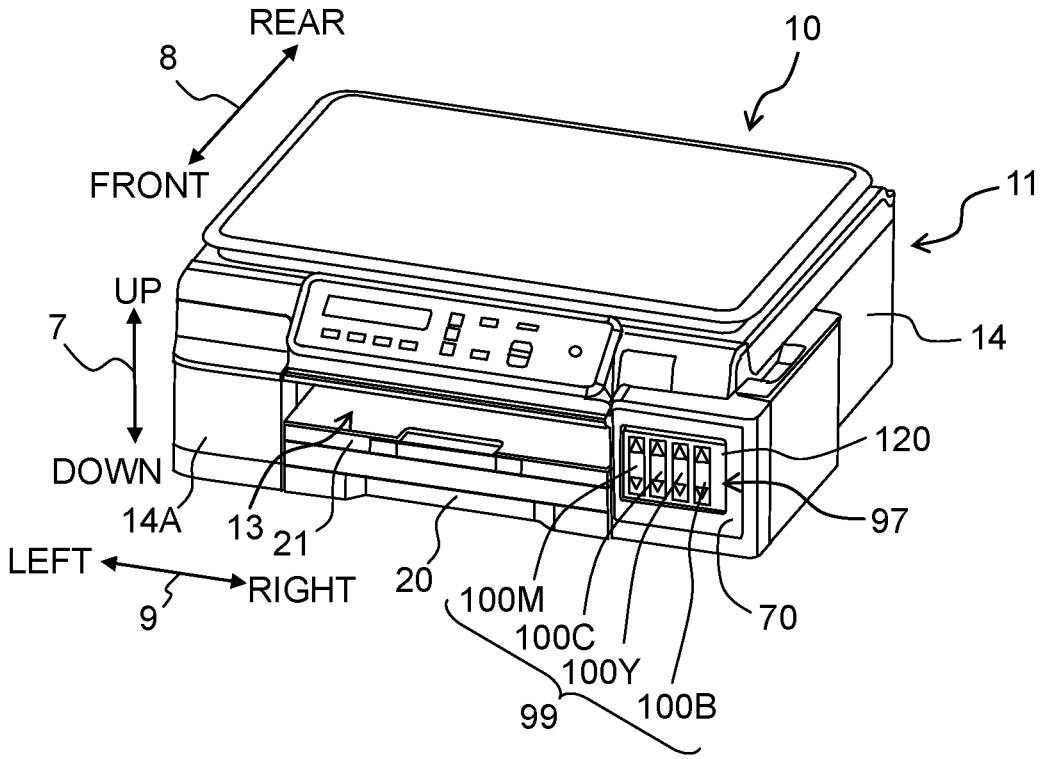

An embodiment of the present teaching will be described below. Note that the embodiment described below is merely an example of the present teaching, and it goes without saying that the embodiment of the present teaching may be appropriately changed in a range that does not alter the gist or essential characteristics of the present teaching. In the description below, a posture (the posture of FIGS. 1A and 1B) where a multifunction peripheral 10 and an ink tank 100 installed in the multifunction peripheral 10 are usably disposed in a horizontal plane will be described as a "usable posture". An up-down direction 7 is defined with reference to the usable posture. A front-rear direction 8 (an example of a second direction) is defined assuming a surface provided with an opening 13 of the multifunction peripheral 10 to be a front surface. A left-right direction 9 (an example of a first direction) is defined viewing the multifunction peripheral 10 from the front surface. The up-down direction 7, the front-rear direction 8, and the left-right direction 9 are orthogonal to each other. In the present embodiment, in the usable posture, the up-down direction 7 corresponds to a vertical direction, and the front-rear direction 8 and the left-right direction 9 correspond to horizontal directions. Note that an upward orientation is a component of the up-down direction 7, and a downward orientation is also a component of the up-down direction 7. Similarly, a leftward orientation and a rightward orientation are each components of the left-right direction 9. A frontward orientation and a rearward orientation are each components of the front-rear direction 8.

<Overall Structure of Multifunction Peripheral 10>

Figure 1B:
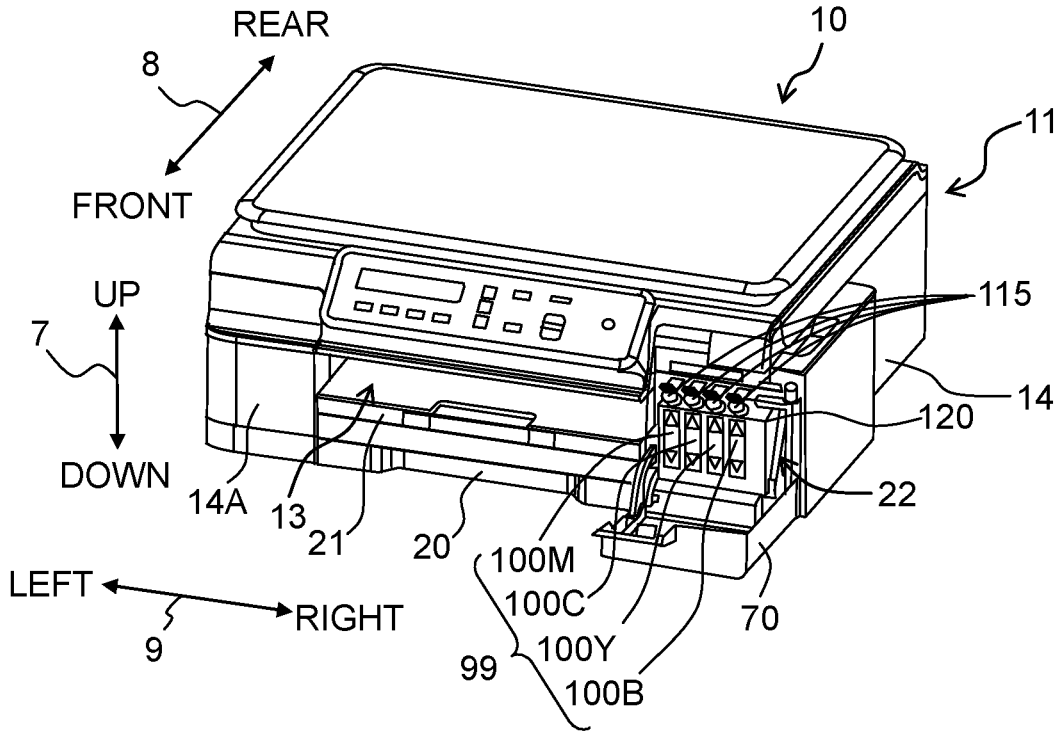
Figure 2:
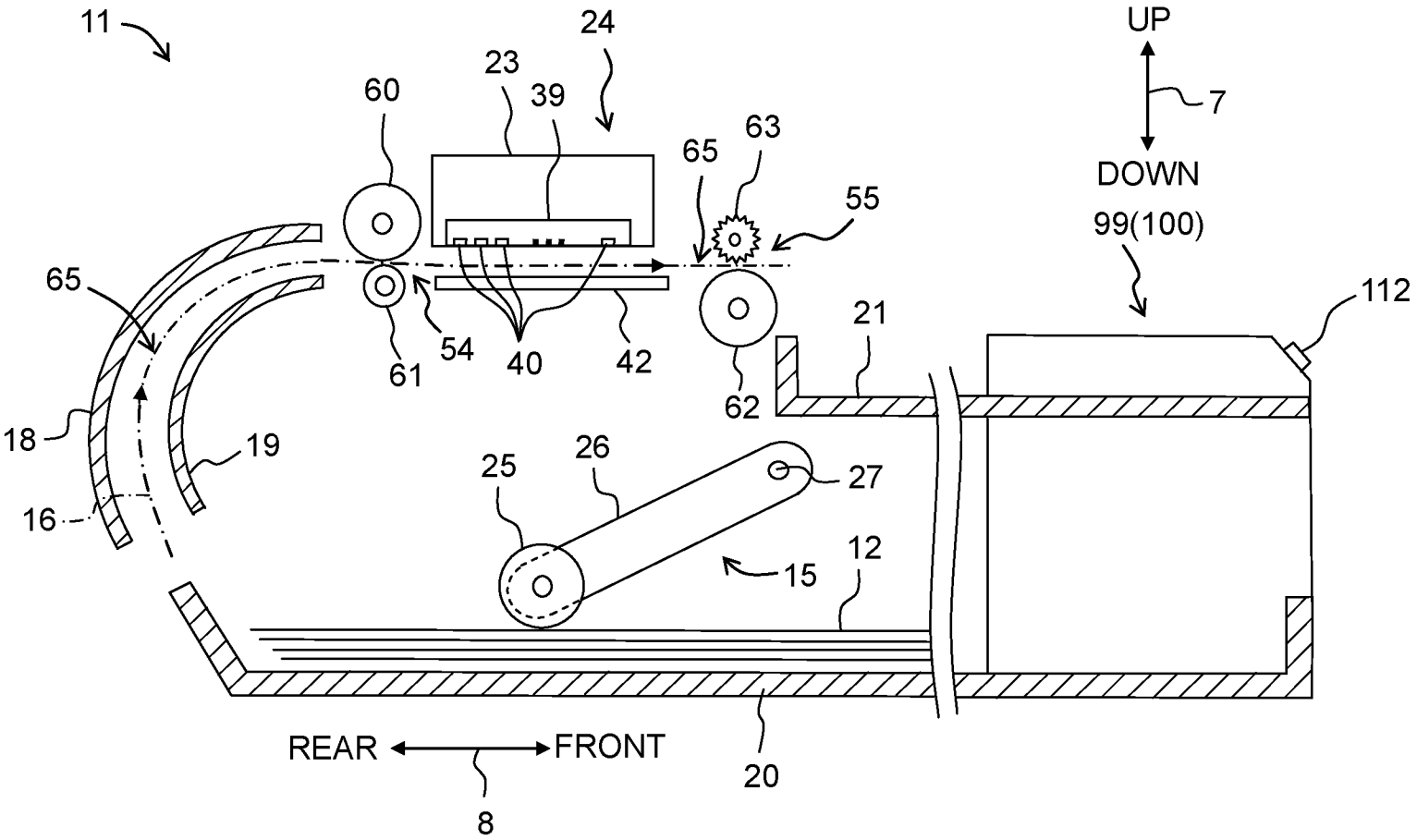
FIG. 2 is a longitudinal cross-sectional view schematically depicting an internal structure of a printer unit.

As depicted in FIGS. 1A and 1B, the multifunction peripheral 10 (an example of a supply apparatus) has roughly a rectangular parallelepiped shape. A printer unit 11 that records an image on a sheet 12 (refer to FIG. 2) by an ink-jet recording system, is provided in a lower section of the multifunction peripheral 10. The printer unit 11 has a casing 14. The opening 13 is formed in a front wall 14A of the casing 14. As depicted in FIG. 2, the following are disposed on the inside of the casing 14, namely, a feed unit 15, a feed tray 20, a discharge tray 21, a conveyance roller unit 54, a recording unit 24, a discharge roller unit 55, a platen 42, a tank set 99, and a binder 120 (refer to FIGS. 7A and 7B). The multifunction peripheral 10 has various functions such as a facsimile function and a print function.

<Feed Tray 20, Discharge Tray 21>

The opening 13 is formed in the front surface and in a central section in the left-right direction 9 of the multifunction peripheral 10. As depicted in FIGS. 1A and 1B, the feed tray 20 is inserted/removed in the front-rear direction 8 into/from the multifunction peripheral 10, via the opening 13, by a user. The feed tray 20 can support a stacked plurality of the sheets 12. The discharge tray 21 is disposed above the feed tray 20 and is inserted into and removed from the multifunction peripheral 10 together with the feed tray 20. The discharge tray 21 supports the sheet 12 that has been discharged from between the recording unit 24 and the platen 42 by the discharge roller unit 55.

<Feed Unit 15>

The feed unit 15 feeds to a conveyance passage 65 the sheet 12 supported by the feed tray 20. As depicted in FIG. 2, the feed unit 15 includes a feed roller 25, a feed arm 26, and a shaft 27. The feed roller 25 is rotatably supported by a distal end of the feed arm 26. Reverse rotation of a conveyance motor (not illustrated) results in the feed roller 25 rotating such that the sheet 12 is conveyed in a conveyance orientation 16. Hereafter, the feed roller 25, a conveyance roller 60, and a discharge roller 62 rotating in an orientation by which the sheet 12 is conveyed in the conveyance orientation 16 will be described as "forward rotation". The feed arm 26 is pivotably supported by the shaft 27 which is supported by a frame of the printer unit 11. The feed arm 26 is biased so as to pivot toward the feed tray 20 by its own weight or elastic force of a spring or the like.

<Conveyance Passage 65>

Figure 3:
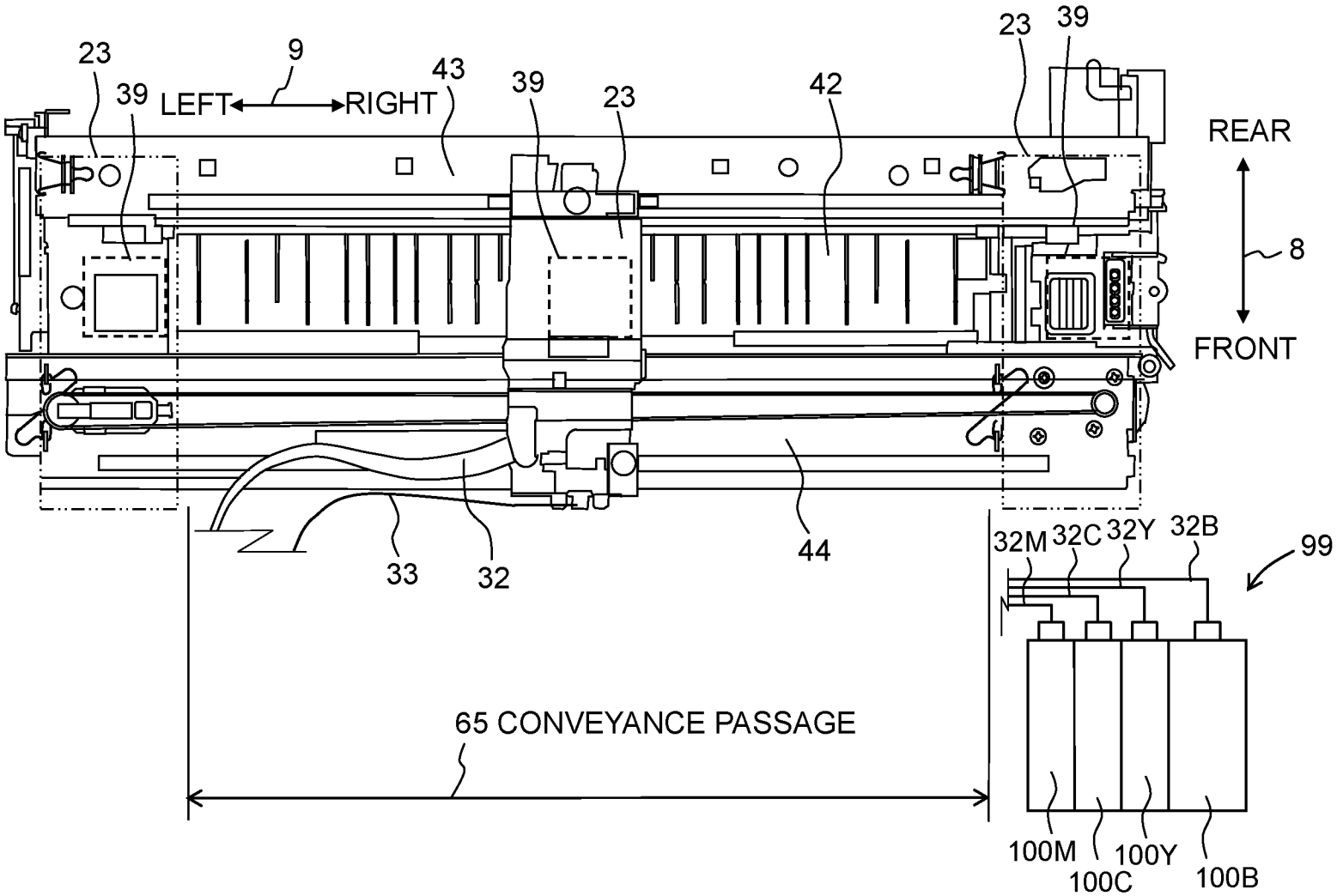
FIG. 3 is a plan view depicting an arrangement of a carriage and a tank set.

As depicted in FIG. 2, the conveyance passage 65 is a passage that extends to a rear of the printer unit 11 from a rear end section of the feed tray 20, makes a U-turn frontward while extending upwardly at the rear of the printer unit 11, and passes along a space between the recording unit 24 and the platen 42 to reach the discharge tray 21. Part of the conveyance passage 65 is a space formed by an outer guide member 18 and an inner guide member 19 that face each other with a certain spacing therebetween inside the printer unit 11. As depicted in FIGS. 2 and 3, a portion between the conveyance roller unit 54 and the discharge roller unit 55, of the conveyance passage 65 is provided in roughly the central section in the left-right direction 9 of the multifunction peripheral 10, and extends in the front-rear direction 8. The conveyance orientation 16 of the sheet 12 in the conveyance passage 65 is indicated by a dot-chain line arrow in FIG. 2.

<Conveyance Roller Unit 54>

As depicted in FIG. 2, the conveyance roller unit 54 is disposed in the conveyance passage 65. The conveyance roller unit 54 includes the conveyance roller 60 and a pinch roller 61 that face each other. The conveyance roller 60 is driven by the conveyance motor. The pinch roller 61 rotates in company with rotation of the conveyance roller 60. The sheet 12 is nipped by the pinch roller 61 and the conveyance roller 60 that forwardly rotates by forward rotation of the conveyance motor, whereby the sheet 12 is conveyed in the conveyance orientation 16.

<Discharge Roller Unit 55>

As depicted in FIG. 2, the discharge roller unit 55 is disposed downstream in the conveyance orientation 16 of the conveyance roller unit 54 in the conveyance passage 65. The discharge roller unit 55 includes the discharge roller 62 and a spur wheel 63 that face each other. The discharge roller 62 is driven by the conveyance motor. The spur wheel 63 rotates in company with rotation of the discharge roller 62. The sheet 12 is nipped by the discharge roller 62 that forwardly rotates by forward rotation of the conveyance motor, and the spur wheel 63, whereby the sheet 12 is conveyed in the conveyance orientation 16.

<Recording Unit 24>

As depicted in FIG. 2, the recording unit 24 is disposed between the conveyance roller unit 54 and the discharge roller unit 55 in the conveyance orientation 16. The recording unit 24 is disposed so as to face the platen 42 in the up-down direction 7, sandwiching the conveyance passage 65 between itself and the platen 42. The recording unit 24 includes a carriage 23 and a recording head 39.

As depicted in FIG. 3, the carriage 23 is supported by guide rails 43, 44 that are disposed separated in the front-rear direction 8 and each provided extending in the left-right direction 9. The guide rails 43, 44 are supported by the frame of the printer unit 11. The carriage 23 is coupled to a publicly known belt mechanism provided in the guide rail 44. The belt mechanism is driven by a carriage motor (not illustrated). The carriage 23 coupled to the belt mechanism makes a reciprocating movement along the left-right direction 9 by drive of the carriage motor. A range of movement of the carriage 23 reaches to outer sides in the left-right direction 9 of the conveyance passage 65, as depicted by the dot-chain lines of FIG. 3.

Ink tubes 32 and a flexible flat cable 33 are extended out from the carriage 23.

The ink tubes 32 connect the tank set 99 and the recording head 39. The ink tubes 32 supply the recording head 39 with ink (an example of liquid) stored in four ink tanks 100B, 100Y, 100C, 100M (these are sometimes indicated collectively as "ink tank 100") that configure the tank set 99. The ink tank 100 is an example of a tank. In detail, four ink tubes 32B, 32Y, 32C, 32M in which black, yellow, cyan, magenta inks flow are respectively extended out from the ink tanks 100B, 100Y, 100C, 100M, and connected to the carriage 23 in a state that these ink tubes 32B, 32Y, 32C, 32M have been bundled. The four ink tubes 32B, 32Y, 32C, 32M are sometimes described collectively as "ink tube 32".

The flexible flat cable 33 electrically connects a control board on which a control unit (not illustrated) is mounted and the recording head 39. The flexible flat cable 33 transmits to the recording head 39 a control signal outputted from the control unit.

As depicted in FIG. 2, the recording head 39 is mounted in the carriage 23. Nozzles 40 are disposed in a lower surface of the recording head 39. Tips of the nozzles 40 are exposed from the lower surface of the recording head 39. The recording head 39 discharges ink from the nozzle 40 as minute ink droplets. In a process of the carriage 23 moving, the recording head 39 discharges the ink droplets toward the sheet 12 supported by the platen 42. As a result, an image is recorded on the sheet 12. Moreover, as a result, ink stored in the ink tanks 100B, 100Y, 100C, 100M is consumed.

<Platen 42>

As depicted in FIGS. 2 and 3, the platen 42 is disposed between the conveyance roller unit 54 and the discharge roller unit 55, in relation to the conveyance orientation 16. The platen 42 is disposed so as to face the recording unit 24 in the up-down direction 7, sandwiching the conveyance passage 65 between itself and the recording unit 24. The platen 42 supports, from below, the sheet 12 conveyed by the conveyance roller unit 54.

<Cover 70>

As depicted in FIG. 1B, an opening 22 is formed in a right section of the front wall 14A (an example of a side wall) of the casing 14. A cover 70 is installed in the casing 14 so as to cover the opening 22. The cover 70 is pivotable between a closed position where the opening 22 is covered (position depicted in FIG. 1A) and an open position where the opening 22 is exposed (position depicted in FIG. 1B).

A space extends rearward of the opening 22 inside of the casing 14. The later-mentioned tank set 99 is disposed in this space. A front end of the space is demarcated by the cover 70 in the closed position. A rear end of the space is demarcated by an inner wall (not illustrated) disposed facing the cover 70 rearward of the cover 70.

Note that in the present embodiment, the cover 70 moves to the closed position and the open position by pivoting. However, a movement mode between the closed position and the open position is not limited to pivoting. For example, the cover 70 may be configured to be attachable/detachable to/from the casing 14. In this case, the cover 70 in a state of being attached to the casing 14 is the cover 70 in the closed position, and the cover 70 in a state of being detached from the casing 14 is the cover 70 in the open position.

<Tank Set 99>

Figure 7A:
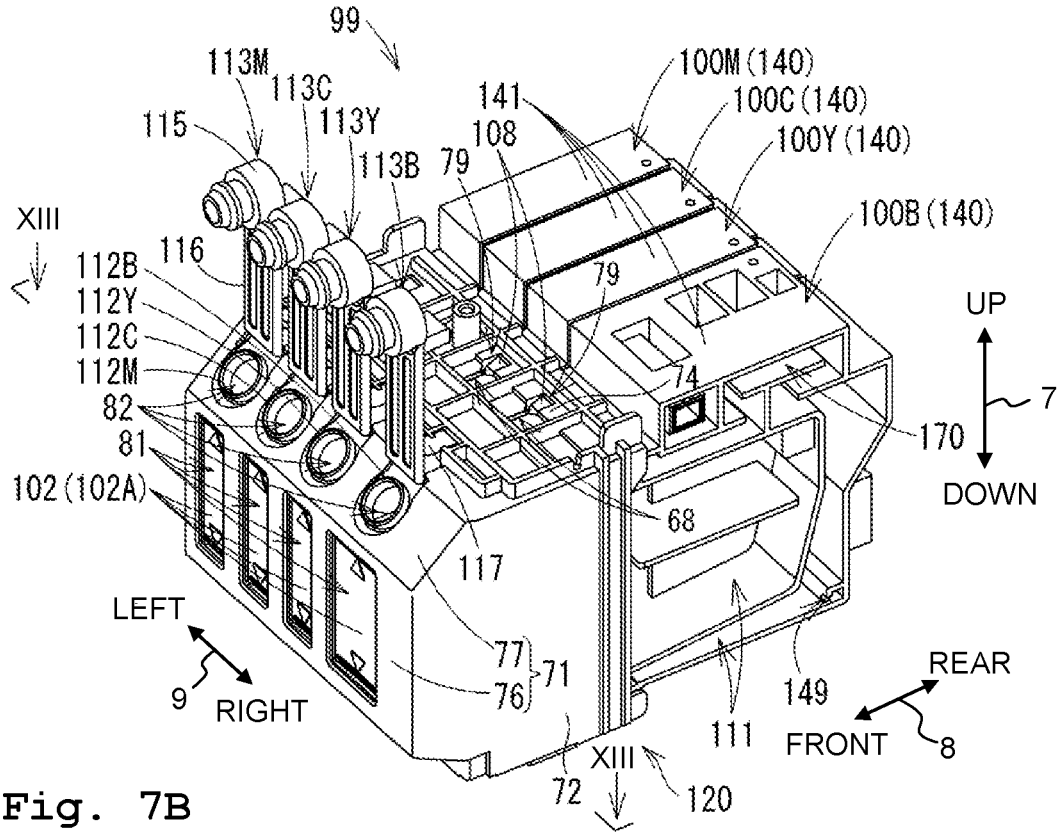
FIG. 7A is a front perspective view of a tank set.
Figure 7B:
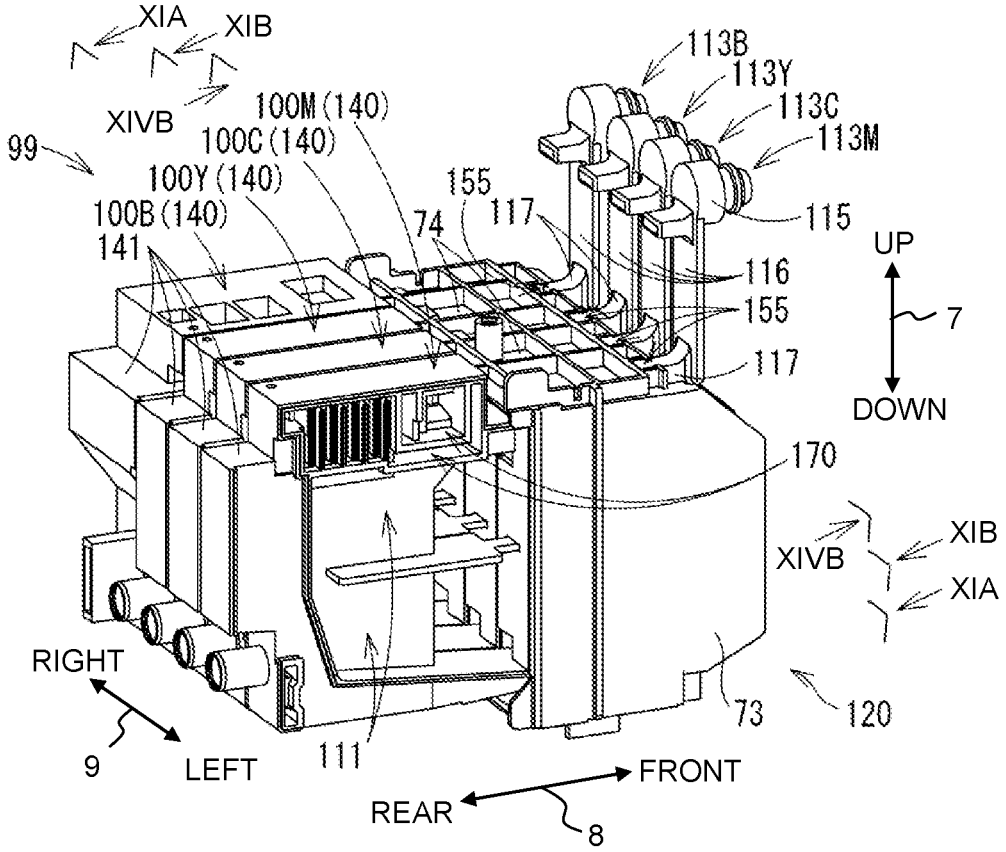
FIG. 7B is a rear perspective view of the tank set.

The tank set 99 stores the ink to be supplied to the recording head 39. As depicted in FIGS. 7A and 7B, the tank set 99 includes the four ink tanks 100B, 100Y, 100C, 100M, the binder 120.

Different colors of inks are stored in the ink tanks 100B, 100Y, 100C, 100M, respectively. Specifically, black ink is stored in the ink tank 100B, yellow ink is stored in the ink tank 100Y, cyan ink is stored in the ink tank 100C, and magenta ink is stored in the ink tank 100M. However, the number of ink tanks 100 and colors of the inks are not limited to the above-described example. Structure of each of the ink tanks 100 will be mentioned later.

The binder 120 holds the four ink tanks 100B, 100Y, 100C, 100M in a state of being aligned along the left-right direction 9. Structure of the binder 120 will be mentioned later.

The four ink tanks 100B, 100Y, 100C, 100M are disposed in line along the left-right direction 9. Of the four ink tanks 100B, 100Y, 100C, 100M, the ink tank 100B is disposed most rightward, and the ink tank 100M is disposed most leftward. Note that arrangement positions of the ink tanks 100 are not limited to the above-described example. The ink tank 100B for black ink has a size, particularly a width in the left-right direction 9 which is larger than those of the ink tanks 100Y, 100C, 100M for color inks. Note that a magnitude relationship of sizes of the ink tanks 100 is not limited to the above-described example. The ink tank 100B has a permissible storage amount of ink which is larger than those of the other ink tanks 100Y, 100C, 100M. Note that a magnitude relationship of permissible storage amounts of the ink tanks 100 is not limited to the above-described example.

As depicted in FIGS. 1A and 1B, the tank set 99 is installed in a right front section inside the casing 14. In other words, the tank set 99 is fixed to the multifunction peripheral 10 such that it cannot be easily removed from the multifunction peripheral 10. Note that "cannot be easily removed" means, for example, that the user cannot easily remove the tank set 99 from the casing 14 of the multifunction peripheral 10 in a state of ordinary use, and excludes cases such as when a skilled repairer removes the tank set 99 from the casing 14 of the multifunction peripheral 10 for repair. Therefore, the user should not be able to easily remove the tank set 99 from the casing 14 of the multifunction peripheral 10 in a state of ordinary use.

<Ink Tank 100>

Structure of the ink tanks 100 will be described in detail below. Since structure of the ink tanks 100Y, 100C, 100M for color inks are the same, hereafter, one of the ink tanks 100Y, 100C, 100M will be referred to as the ink tank 100 and its structure will be described. Moreover, structure of the ink tank 100B for black ink is similar to the structure of the ink tanks 100Y, 100C, 100M, hence after the structure of the ink tanks 100Y, 100C, 100M has been described, the structure of the ink tank 100B for black ink will be described for portions different from in the ink tanks 100Y, 100C, 100M. In this case, structure having a similar function even though shapes somewhat differ in the structure of the ink tank 100B and the ink tanks 100Y, 100C, 100M, will be assigned with identical reference symbols. Note that in the description below, unless specifically stated otherwise, the multifunction peripheral 10 and the ink tank 100 installed in the multifunction peripheral 10 are in the usable posture.

Figure 4A:
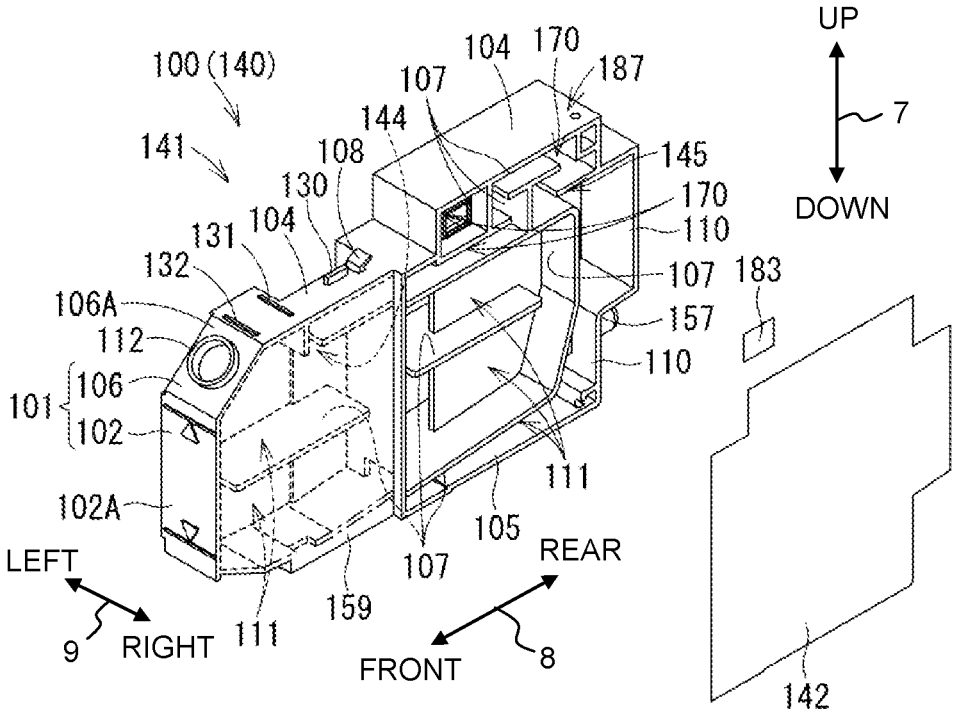
FIG. 4A is a front perspective view of an ink tank.
Figure 4B:
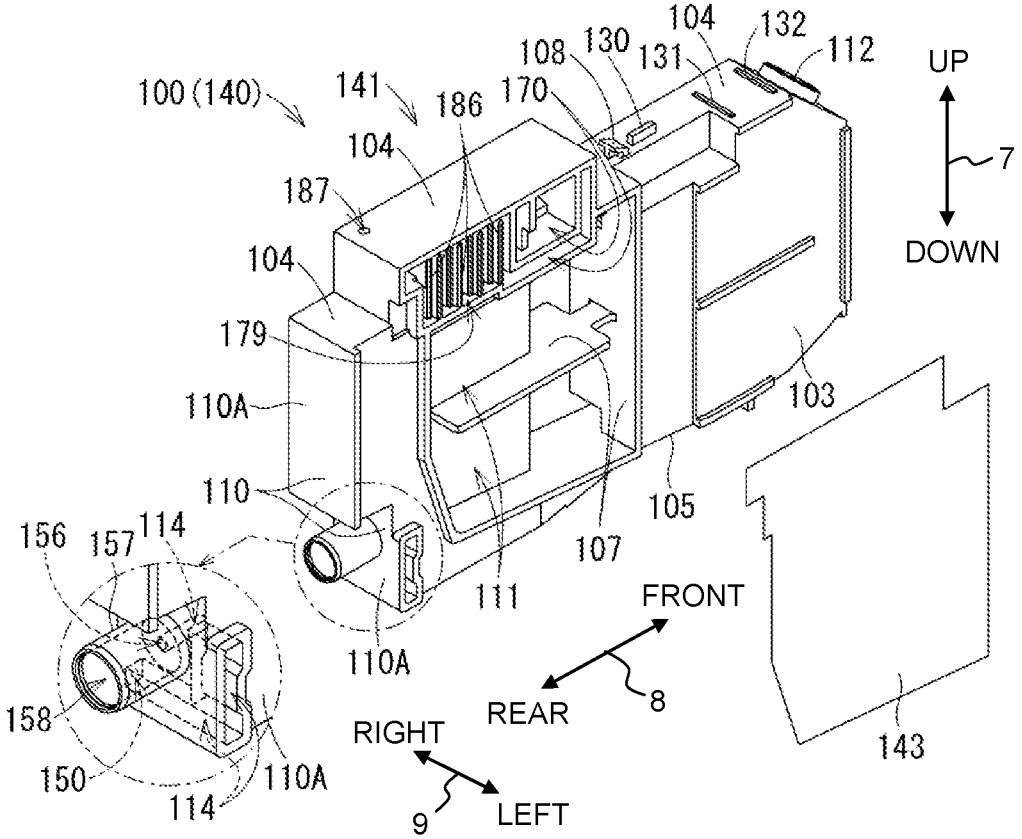
FIG. 4B is a rear perspective view of the ink tank.

As depicted in FIGS. 4A and 4B, the ink tank 100 is formed by a casing 140 forming an outer shape of the ink tank. The casing 140 includes a frame 141 and two films 142, 143.

The frame 141 has a flat rectangular parallelepiped shape in which a dimension in the left-right direction 9 is short and dimensions in the up-down direction 7 and the front-rear direction 8 are longer than the dimension in the left-right direction 9. Moreover, the dimension in the front-rear direction 8 is longer than the dimension in the up-down direction 7.

The frame 141 is formed by a resin having sufficient translucency to enable ink in an ink chamber 111 to be visually confirmed from the outside of the ink tank 100. The frame 141 is formed by, for example, polypropylene. The frame 141 is integrally molded by, for example, injection molding a resin material. Rigidity of the frame 141 is higher than rigidity of the films 142, 143. In other words, the films 142 and 143 are thinner and more flexible than the frame 141. Therefore, the films 142 and 143 are broken by mechanical shock, external force, or the like, more easily as compared with the frame 141.

Note that the frame 141 may have structure in which a plurality of members is combined, rather than being integrally molded.

The frame 141 includes a front wall 101, a right wall 159, a left wall 103, an upper wall 104, a lower wall 105, a rear wall 110, and inner walls 107.

The front wall 101 is configured by an upright wall 102 and an inclined wall 106. The upright wall 102 extends in the up-down direction 7 and the left-right direction 9. The inclined wall 106 joins an upper end of the upright wall 102 and a front end of the upper wall 104. The inclined wall 106 inclines with respect to the up-down direction 7 and the front-rear direction 8.

A front surface 102A of the upright wall 102 and a front surface 106A of the inclined wall 106 in each of the ink tanks 100, in other words a front surface of the frame 141 of each of the ink tanks 100, is exposed to the outside of the multifunction peripheral 10, via the opening 97 of the cover 70 and the opening 22 of the casing 14. That is, each of the ink tanks 100 is disposed in the casing 14 such that the front portion (an example of an end) of the frame 141 is accessible from the outside of the casing 14 via the opening 22 and the opening 97. Due to there being such structure, the front surface of the frame 141 of each of the ink tanks 100 is visually confirmable from a front of the multifunction peripheral 10, and the user can visually confirm a residual amount of ink stored in each of the ink tanks 100.

The right wall 159 extends rearward from a right end of the front wall 101. An upper end of the right wall 159 is connected to a front section of the upper wall 104. A lower end of the right wall 159 is connected to a front section of the lower wall 105. In other words, the right wall 159 is provided only in a front section of the frame 141 and is not provided in a rear section of the frame 141.

The left wall 103 extends rearward from a left end of the front wall 101. An upper end of the left wall 103 is connected to the front section of the upper wall 104. A lower end of the left wall 103 is connected to the front section of the lower wall 105. In other words, the left wall 103 is provided only in the front section of the frame 141 and is not provided in the rear section of the frame 141. The left wall 103 faces the right wall 159 in the left-right direction 9.

The upper wall 104 extends rearward from an upper end of the front wall 101 (rear end of the inclined wall 106). The front section of the upper wall 104 is connected to the upper end of the left wall 103.

The lower wall 105 extends rearward from a lower end of the front wall 101. The lower wall 105 is formed separated downwardly from the upper wall 104. As mentioned above, the front section of the lower wall 105 is connected to the lower end of the left wall 103.

A plurality of the inner walls 107 are disposed in a space surrounded by the front wall 101, the left wall 103, the upper wall 104, the lower wall 105, and the rear wall 110.

As depicted in FIG. 4A, a right surface of the frame 141 is open. The film 142 is welded to right surfaces of the lower wall 105, the rear wall 110, the upper wall 104, and the inner walls 107, whereby the right surface of the frame 141 is sealed.

As depicted in FIG. 4B, a rear section of the left surface of the frame 141 is open. The film 143 is welded to left surfaces of the lower wall 105, the rear wall 110, the upper wall 104, and the inner wall 107, whereby the left surface of the frame 141 is sealed.

The front surface of the frame 141 (the front surface 102A of the upright wall 102 and the front surface 106A of the inclined wall 106) is fastened by a front end of the right surface of the frame 141 and a front end of the left surface of the frame 141. A rear surface of the frame 141 (a rear surface 110A of the rear wall 110) is fastened by a rear end of the right surface of the frame 141 and a rear end of the left surface of the frame 141. The right surface of the frame 141 and the left surface of the frame 141 face each other in the left-right direction 9.

Figure 6:
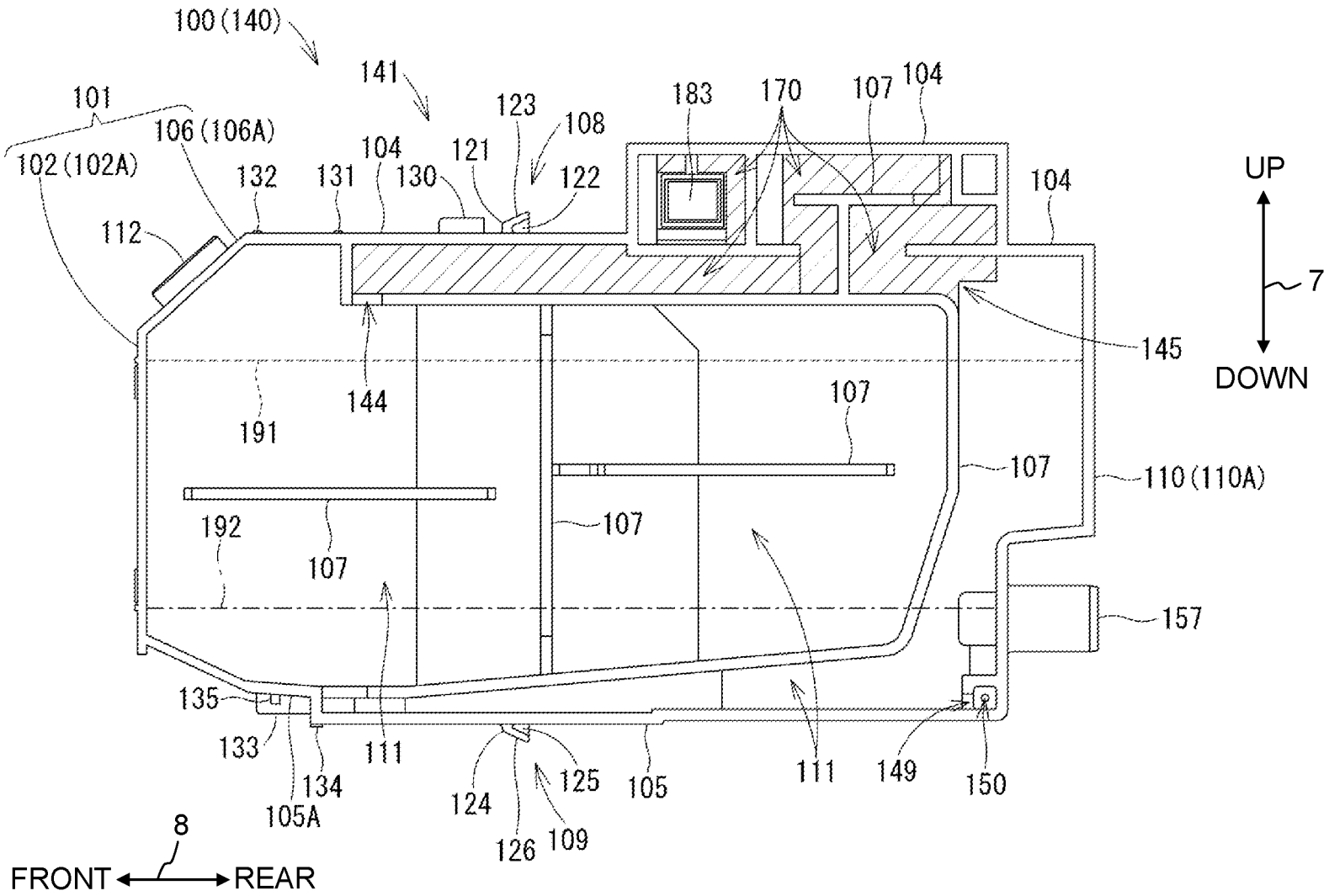
FIG. 6 is a right side view of the ink tank.

As depicted in FIGS. 4A, 4B and 6, a protrusion 108 is formed in the upper wall 104. As depicted in FIG. 6, the protrusion 108 is configured by a plate section 121 and a rib 122. The plate section 121 has an inclined surface 123 extending upwardly rearward. The rib 122 is disposed so as to link the plate section 121 and the upper wall 104. The rib 122 is shorter in the left-right direction 9 than the plate section 121. Due to there being such structure, the protrusion 108 bends downwardly by force in at least one of a rearward or a downward orientation acting on the inclined surface 123.

As depicted in FIG. 6, a protrusion 109 is formed in the lower wall 105. The protrusion 109 is configured by a plate section 124 and a rib 125. The plate section 124 has an inclined surface 126 extending downwardly rearward. The rib 125 is disposed so as to link the plate section 124 and the lower wall 105. The rib 125 is shorter in the left-right direction 9 than the plate section 124. Due to there being such structure, the protrusion 109 bends upwardly by force in at least one of a rearward or an upward orientation acting on the inclined surface 126.

As depicted in FIGS. 4A and 4B and FIG. 6, a protrusion 130 is formed in the upper wall 104. The protrusion 130 is formed on a front side of the protrusion 108. The protrusion 130 extends in the front-rear direction 8.

Protrusions 131 and 132 are formed in the upper wall 104. The protrusions 131 and 132 are formed on a front side of the protrusion 130. The protrusion 132 is formed on a front side of the protrusion 131. The protrusions 131 and 132 extend in the left-right direction 9.

As depicted in FIG. 6, a protrusion 133 is formed in the lower wall 105. The protrusion 133 is formed in a sub lower wall 105A. The sub lower wall 105A is formed in a front section of the lower wall 105, and is positioned more upwardly than the lower wall 105.

A protrusion 134 is formed in the lower wall 105. The protrusion 134 is formed on a front side of the protrusion 109. The protrusion 134 extends in the left-right direction 9.

A protrusion 135 is formed in the sub lower wall 105A. The protrusion 135 extends in the left-right direction 9. In the present embodiment, the protrusion 135 extends to right and left from the protrusion 133. A protruding length downward of the protrusion 135 is shorter than a protruding length downward of the protrusion 133. In other words, a protruding tip of the protrusion 135 is positioned more upwardly than a protruding tip of the protrusion 133.

<Ink Chamber 111>

As depicted in FIGS. 4A and 4B, the casing 140 has the ink chamber 111 (an example of a liquid storage chamber) inside thereof. The ink chamber 111 is an internal space, of the ink tank 100, to store ink.

The ink chamber 111 is demarcated by the front wall 101, the right wall 159, the left wall 103, the upper wall 104, the lower wall 105, the rear wall 110, the inner walls 107, the film 142, and the film 143.

Specifically, a front side of the ink chamber 111 is demarcated by a rear surface of the front wall 101. A rear side of the ink chamber 111 is demarcated by a front surface of the rear wall 110. An upper side of the ink chamber 111 is demarcated by a lower surface of the upper wall 104. A lower side of the ink chamber 111 is demarcated by an upper surface of the lower wall 105. A right side of the ink chamber 111 is demarcated by a left surface of the right wall 159 and a left surface of the film 142. Further, a left side of the ink chamber 111 is demarcated by a right surface of the left wall 103 and a right surface of the film 143. The ink chamber 111 is divided into plural sub chambers by the inner walls 107.

The left surface of the right wall 159 and the left surface of the film 142 face the right surface of the left wall 103 and the right surface of the film 143 in the left-right direction 9. The left surface of the right wall 159 and the left surface of the film 142, and the right surface of the left wall 103 and the right surface of the film 143 are examples of inner side surfaces of two side surfaces. In this embodiment, each of the two side surfaces has a portion formed from resin and a portion formed from a film. Each of the left surface of the right wall 159 and the right surface of the left wall 103, which is formed from resin, is an example of a first surface. Each of the left surface of the film 142 and the right surface of the film 143 is an example of a second surface.

As described above, in this embodiment, the right and left sides of the ink chamber 111 are demarcated by the films (the films 142 and 143) and the resin (the right wall 159 and the left wall 103). However, one of the right and left sides of the ink chamber 111 may be demarcated only by the resin. For example, the right side of the ink chamber 111 may be demarcated by the film and the resin, and the left side of the ink chamber 111 may be demarcated only by the resin. Namely, the two side surfaces may include portions formed from the resin and one of the two side surfaces may include the portion formed from the film.

<Ink Outflow Passage 114>

As depicted in FIG. 4B, the casing 140 includes an ink outflow passage 114. The ink outflow passage 114 is a communicating path for ink stored in the ink chamber 111 to flow out to outside of the ink tank 100.

One end of the ink outflow passage 114 communicates with the ink chamber 111 via an opening 149 and an opening 150 (refer to FIG. 6) formed in a boundary of the lower wall 105 and the rear wall 110. The other end of the ink outflow passage 114 communicates with a protrusion 157 via an opening 156 formed in the rear wall 110. The opening 156 is positioned above the openings 149, 150.

The protrusion 157 protrudes rearward from a peripheral portion of the opening 156 of the rear surface 110A of the rear wall 110, in other words, to outside of the ink tank 100. The protrusion 157 is hollow. A front end of an internal space of the protrusion 157 communicates with the ink outflow passage 114 via the opening 156. A rear end of the internal space of the protrusion 157 communicates with outside of the ink tank 100.

The protrusion 157 is connected directly or indirectly to the ink tube 32 (see FIG. 3) in a state that the ink tank 100 is installed in the casing 14. This allows the ink, that has entered the internal space of the protrusion 157 from the ink outflow passage 114 via the opening 156, to flow out to the ink tube 32.

As described above, the ink stored in the ink chamber 111 is supplied to each nozzle 40 of the recording head 39 via the ink outflow passage 114, the internal space of the protrusion 157, and the ink tube 32. The protrusion 157 may not be connected directly to the ink tube 32. For example, a first end of a needle may be inserted into the protrusion 157, and a second end of the needle may be connected to the ink tube 32.

<Atmosphere Communication Passage 170>

As depicted in FIGS. 4A, 4B, and 6, the casing 140 has an atmosphere communication passage 170. The atmosphere communication passage 170 communicates the ink chamber 111 and outside of the ink tank 100. In other words, the atmosphere communication passage 170 opens the ink chamber 111 to the atmosphere.

One end of the atmosphere communication passage 170 communicates with the ink chamber 111 via openings 144, 145. The other end of the atmosphere communication passage 170 communicates with an air opening port 187 formed in the upper wall 104.

As depicted in FIG. 6, a semipermeable membrane 183 is attached between the one end and the other end of the atmosphere communication passage 170, so as to block the atmosphere communication passage 170. The semipermeable membrane 183 is a porous membrane having minute holes that block passage of ink and allow passage of gas. For example, the semipermeable membrane 183 is composed of a fluororesin such as polytetrafluoroethylene, polychlorotrifluoroethylene, tetrafluoroethylene-hexafluoropropylene copolymer, tetrafluoroethylene-perfluoroalkylvinyl ether copolymer, tetrafluoroethylene-ethylene copolymer, and so on. As a result, the ink stored in the ink chamber 111 is blocked by the semipermeable membrane 183 and thereby unable to flow out to outside of the ink tank 100 via the air opening port 187. On the other hand, air can move freely between the inside of the ink chamber 111 and outside of the ink tank 100.

As depicted in FIG. 4B, a labyrinth 179 is formed between the air opening port 187 and a position where the semipermeable membrane 183 is attached in the atmosphere communication passage 170. The labyrinth 179 is a communicating path that extends along the front-rear direction 8 while repeating U-turns in the up-down direction 7 by a plurality of separating walls 186 that extend in the up-down direction 7 being provided aligned in the front-rear direction 8.

<Ink Tank 100B>

Figure 5A:
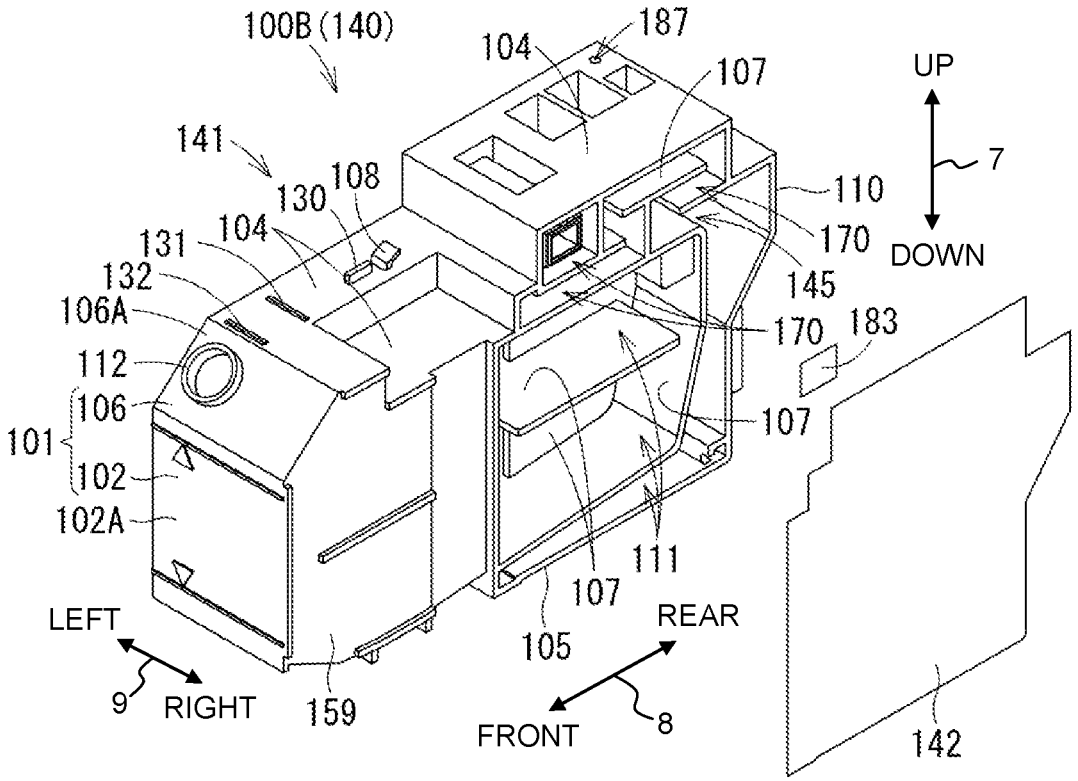
FIG. 5A is a front perspective view of an ink tank for black ink.
Figure 5B:
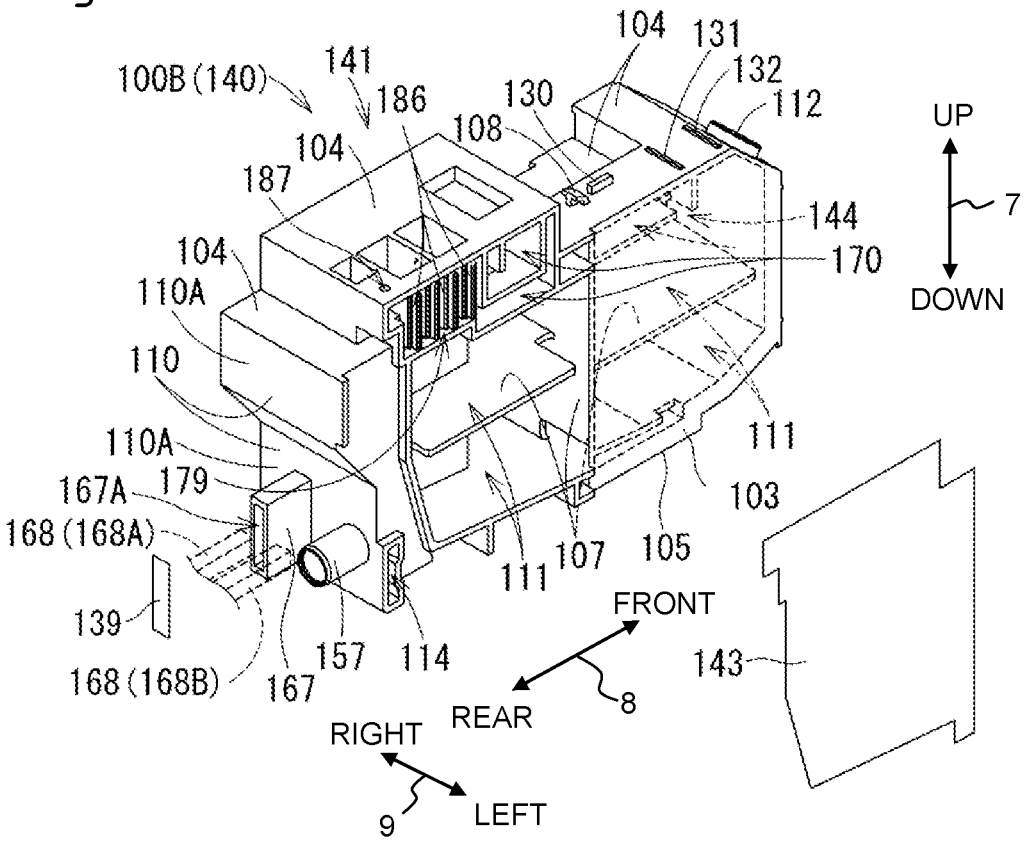
FIG. 5B is a rear perspective view of the ink tank for black ink.

The structure of the ink tank 100B will be described below with reference to FIGS. 5A and 5B. As depicted in FIGS. 5A and 5B, the ink tank 100B is longer in the left-right direction 9 than the ink tanks 100Y, 100C, 100M (refer to FIGS. 4A and 4B).

Portions, of the ink tank 100B, different from the ink tanks 100Y, 100C, 100M will be described below. Note that portions, in the ink tank 100B, having the same structure as in the ink tanks 100Y, 100C, 100M will be assigned with the same reference symbols as in FIGS. 4A and 4B, whereupon descriptions thereof will be omitted. Moreover, in the case that structure of a certain portion in the ink tank 100B differs from structure of a portion corresponding to the certain portion of the ink tanks 100Y, 100C, 100M only in being longer in the left-right direction 9 than the structure of the portion, of the ink tanks 100Y, 100C, 100M, corresponding to the certain portion, the certain portion in the ink tank 100B will be assigned with the same reference symbol as in FIGS. 4A and 4B, whereupon a description thereof will be omitted.

As depicted in FIG. 5B, the frame 141 includes a protrusion 167 (an example of a detected part) protruding rearward from a lower portion of the rear wall 110. An optical sensor 168 described below detects a height of a liquid surface of ink stored in the ink chamber 111 of the ink tank 100 having the usable posture by irradiating the protrusion 167 with light. The protrusion 167 has a rectangular parallelepiped shape. The protrusion 167 includes an internal space 167A. A front end and a rear end of the protrusion 167 are open. The front end of the internal space 167A of the protrusion 167 communicates with the ink chamber 111. The rear end of the protrusion 167 is open. The opened rear end of the protrusion 167 is sealed with a film 139 attached thereto.

In this embodiment, the protrusion 167 is formed on a right side of the protrusion 157. The protrusion 167, however, may be formed in any other position. Further, in this embodiment, the protrusion 167 is provided only in the ink tank 100B among the ink tanks 100B, 100Y, 100C, and 100M. The protrusion 167, however, may be provided in at least one of the ink tanks 100B, 100Y, 100C, and 100M.

<Optical Sensor 168>

As indicated by a broken line in FIG. 5B, the printer unit 11 includes the optical sensor 168. The optical sensor 168 is attached to the casing 14. The optical sensor 168 is located on the right and left sides of the projection 167 of the frame 141 of the ink tank 100B, in a state that the tank set 99 has been installed on the inside of the casing 14.

The optical sensor 168 includes a light emitting section 168A and a light receiving section 168B. The light emitting section 168A and the light receiving section 168B are arranged to sandwich the projection 167 therebetween in the left-right direction 9. The light emitting section 168A is located on a right side of the projection 167. The light receiving section 168B is located on a left side of the projection 167. Note that the arrangement positions of the light emitting section 168A and the light receiving section 168B may be opposite, regarding the left-right direction 9, to the above-described arrangement positions.

The arrangement positions of the light emitting section 168A and the light receiving section 168B in the up-down direction 7 are determined, such that a light emitting position of the light emitting section 168A toward the light receiving section 168B and a light receiving position of the light receiving section 168B from the light emitting section 168A each have a predefined height in the internal space 167A of the protrusion 167.

The optical sensor 168 is electrically connected to a control unit (not depicted in the drawings) of the multifunction peripheral 10 via an electric circuit.

The light is emitted from the light emitting section 168A toward the light receiving section 168B. The emitted light penetrates the projection 167 to enter the internal space 167A of the projection 167. In a case that the liquid surface of the ink stored in the internal space 167A is located above an optical path of the emitted light, the light is blocked (shielded) by the ink stored in the internal space 167A and does not reach the light receiving section 168B. This causes the optical sensor 168 to output a low level signal to the control unit. On the other hand, in a case that the liquid surface of the ink stored in the internal space 167A is located below the optical path, the light advances in the air in the internal space 167A. In that case, the light passes through the internal space 167A and reaches the light receiving section 168B. This causes the optical sensor 168 to output a high level signal to the control unit. Namely, a light-transmitting state of the protrusion 167 depends on the height of the liquid surface of the ink stored in the internal space 167A.

In a case that the signal from the optical sensor 168 is the low level signal, the control unit determines that the liquid surface of the ink stored in the ink chamber 111 is higher than the predefined height; in a case that the signal from the optical sensor 168 is the high level signal, the control unit determines that the liquid surface of the ink stored in the ink chamber 111 is lower than the predefined height.

In this embodiment, the protrusion 167 is provided only in the ink tank 100B and the optical sensor 168 is located on the right and left sides of the protrusion 167 of the frame 141 of the ink tank 100B. However, when the protrusion 167 is provided for each of the ink tanks 100Y, 100C, and 100M, the optical sensor 168 is provided on the right and left side of the protrusion 167 of the frame 141 of each of the ink tanks 100Y, 100C, and 100M.

<Inlet 112>

As depicted in FIG. 7A, inlets 112B, 112Y, 112C, 112M (these are sometimes collectively described as "inlet 112") for filling inks into the ink chambers 111 are formed in the inclined walls 106 of the ink tanks 100B, 100Y, 100C, 100M. The inlet 112 penetrates the inclined wall 106 in a thickness direction to communicate the ink chamber 111 with outside of the ink tank 100.

The inclined wall 106 and the inlet 112 are exposed to outside of the multifunction peripheral 10 via the opening 22, by the cover 70 being positioned in the open position. A posture (filling posture) of the ink tank 100 when ink is filled into the ink chamber 111 via the inlet 112, is the usable posture. That is, ink is filled into the ink chamber 111 via the inlet 112 when the ink tank 100 is in the usable posture.

<Binder 120>

As depicted in FIGS. 7A and 7B, the binder 120 holds the four ink tanks 100B, 100Y, 100C, 100M, in a state of being aligned in the left-right direction 9.

Figure 8A:
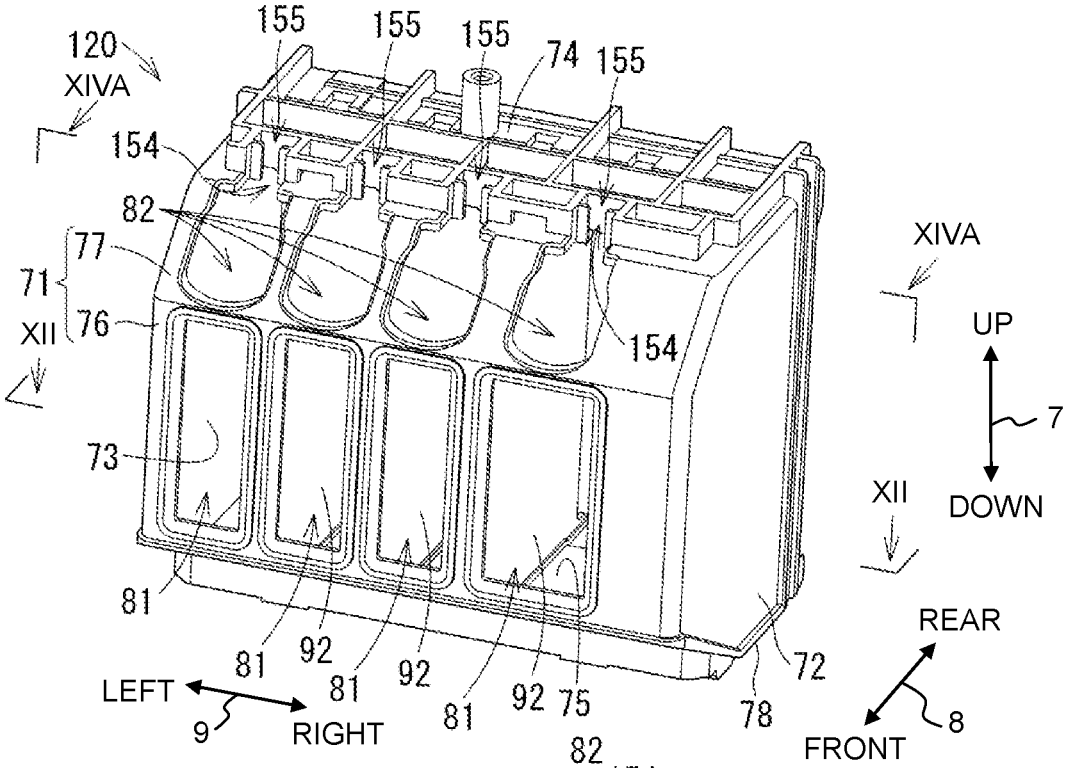
FIG. 8A is a front perspective view of a binder.
Figure 8B:
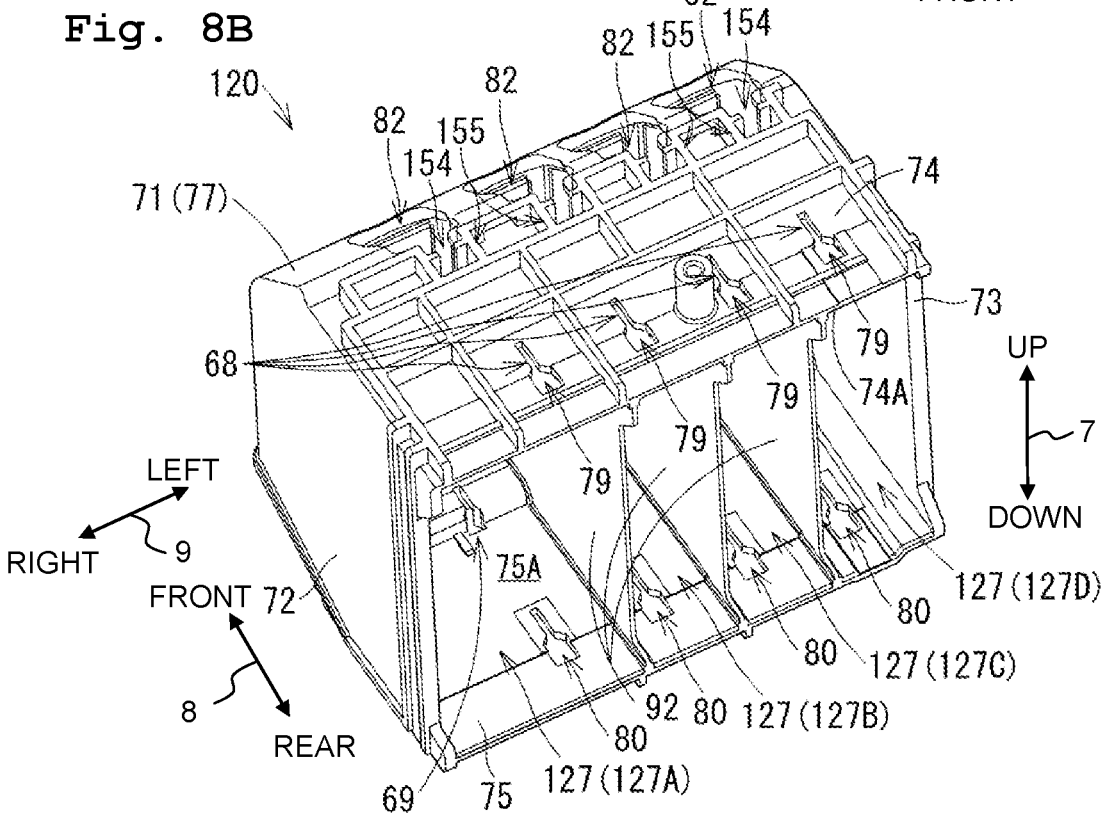
FIG. 8B is a rear perspective view of the binder.
Figure 12:
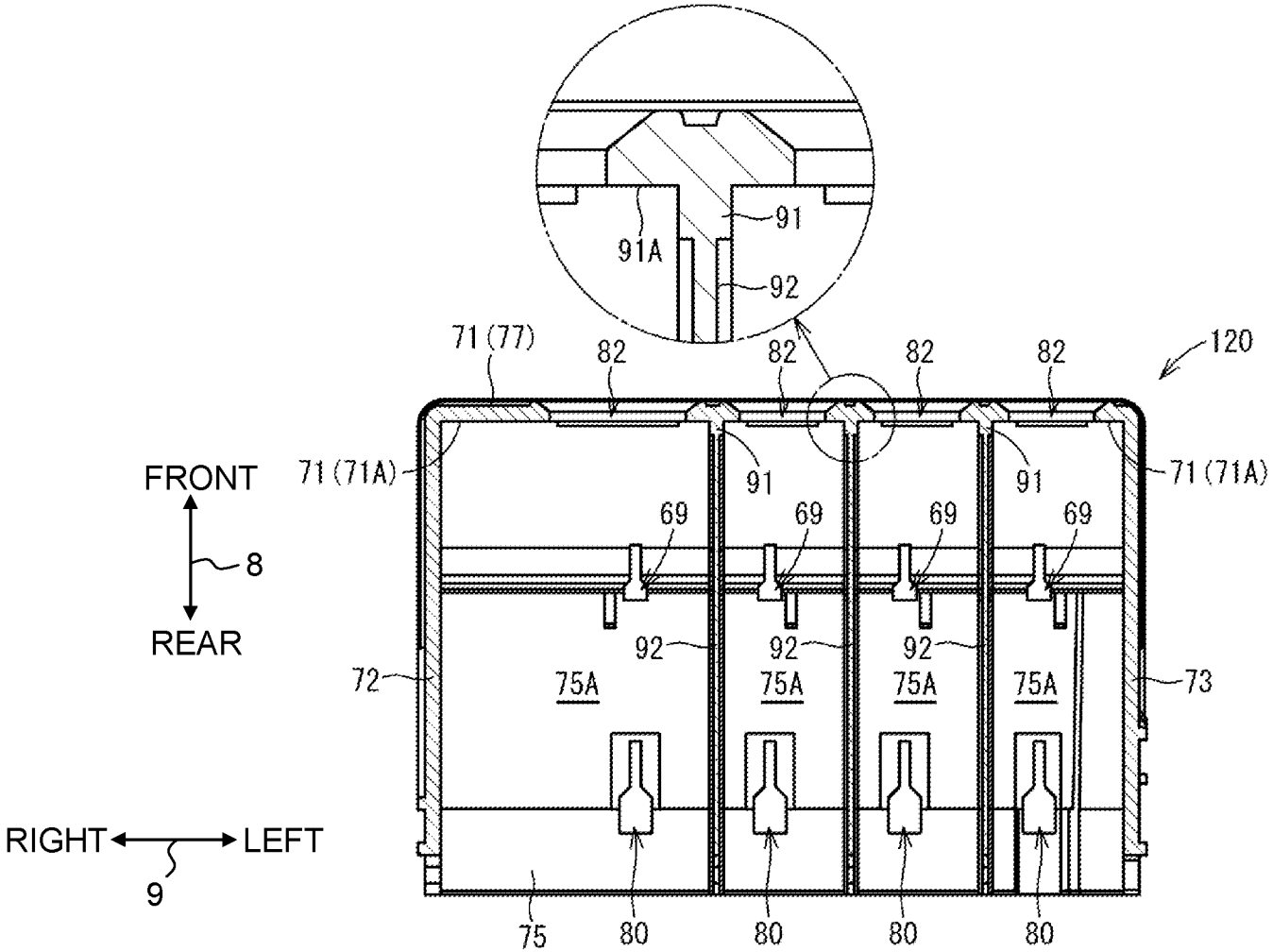
FIG. 12 is a cross-sectional view taken along XII-XII in FIG. 8A.

As depicted in FIGS. 8A and 8B and FIG. 12, the binder 120 includes a front wall 71, a right wall 72, a left wall 73, an upper wall 74, a lower wall 75, positioning walls 91 (an exemplary positioning part), and partition walls 92.

The front wall 71 is configured by an upright wall 76 and an inclined wall 77. The upright wall 76 extends in the up-down direction 7 and the left-right direction 9. The inclined wall 77 joins an upper end of the upright wall 76 and a front end of the upper wall 74. The inclined wall 77 inclines with respect to the up-down direction 7 and the front-rear direction 8.

The right wall 72 extends rearward from a right end of the front wall 71. The left wall 73 extends rearward from a left end of the front wall 71. The upper wall 74 extends rearward from an upper end of the front wall 71 (in detail, an upper end of the inclined wall 77). A right end of the upper wall 74 is connected to an upper end of the right wall 72. A left end of the upper wall 74 is connected to an upper end of the left wall 73. The lower wall 75 extends rearward from a lower end of the front wall 71. A right end of the lower wall 75 is connected to a lower end of the right wall 72. A left end of the lower wall 75 is connected to a lower end of the left wall 73.

Figure 9:
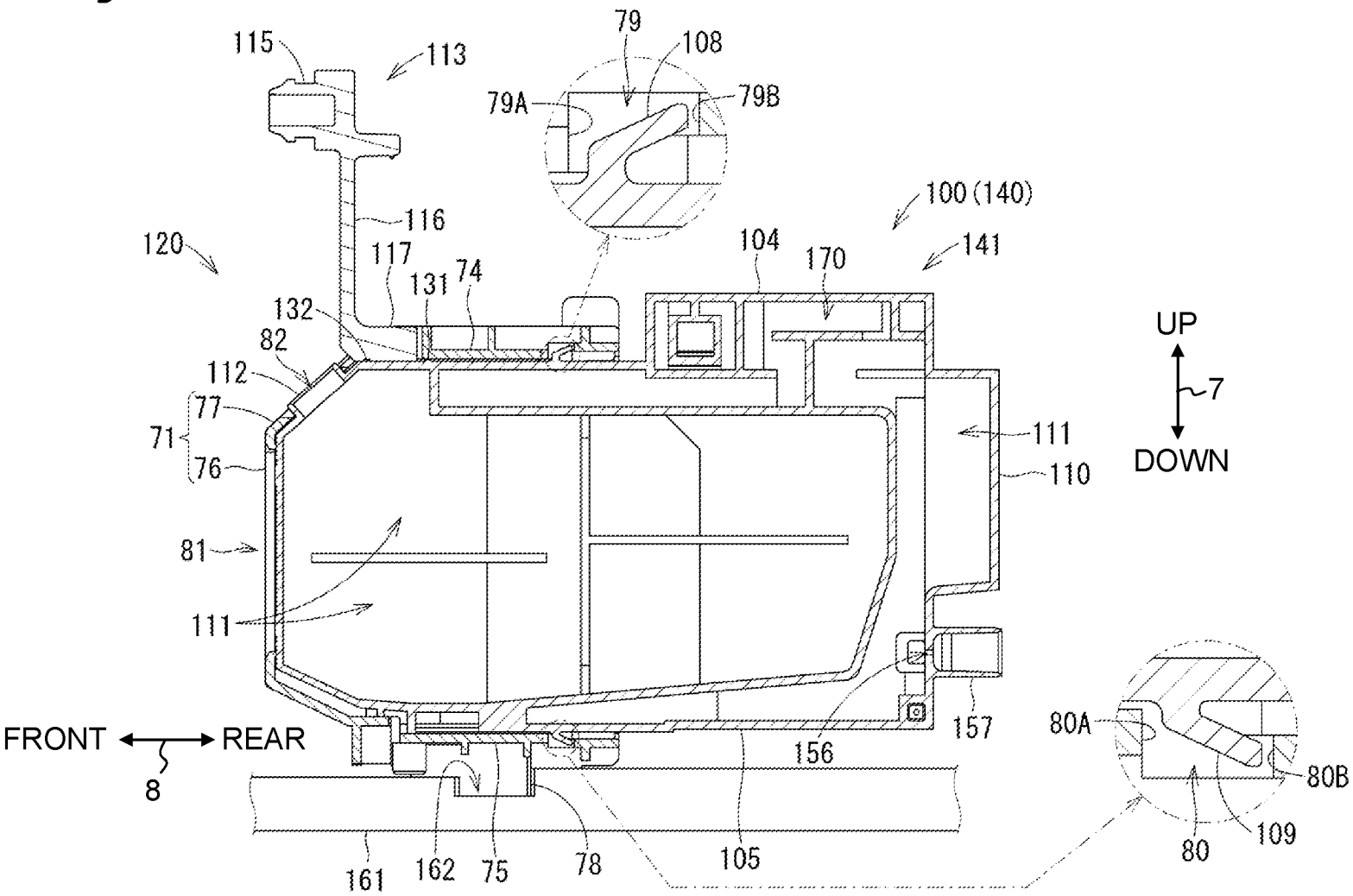
FIG. 9 is a longitudinal cross-sectional view of the ink tank and the binder.

As depicted in FIG. 9, a downwardly extending protrusion 78 is formed in the lower wall 75. As depicted in FIG. 11, the protrusion 78 is formed in each of a right end section and a left end section of the lower wall 75. As depicted in FIG. 9, the protrusion 78 is inserted into a hole 162 formed in a base plate 161 of the casing 14 of the printer unit 11. As a result, the binder 120 is fixed in and supported by the casing.

The binder 120 is fixed in and supported by the casing 14 in a state that the binder 120 holds the ink tank 100 (the state depicted in FIGS. 7A and 7B).

As depicted in FIG. 8B, an internal space 127 of the binder 120 is formed by the front wall 71, the right wall 72, the left wall 73, the upper wall 74, and the lower wall 75. As depicted in FIGS. 7A and 7B, the four ink tanks 100B, 100Y, 100C, 100M are inserted from the rear toward the internal space 127. As a result, front sections of the four ink tanks 100B, 100Y, 100C, 100M occupy the internal space 127.

The internal space 127 is divided into spaces corresponding to the number of ink tanks 100 by the positioning walls 91 and the partition walls 92. In this embodiment, the internal space 127 is divided into four internal spaces 127B, 127Y, 127C, 127M, which respectively correspond to the four ink tanks 100B, 100Y, 100C, 100M, by the positioning walls 91 and the partition walls 92.

Figure 14A:
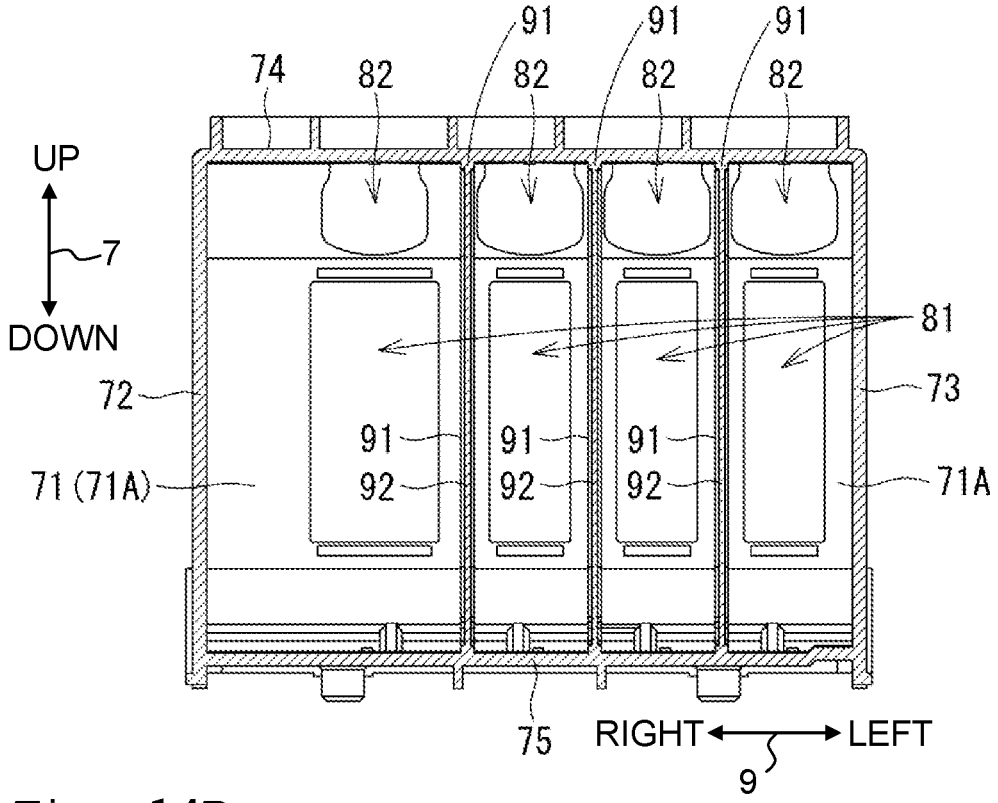
FIG. 14A is a cross-sectional view taken along XIVA-XIVA in FIG. 8A.
Figure 14B:
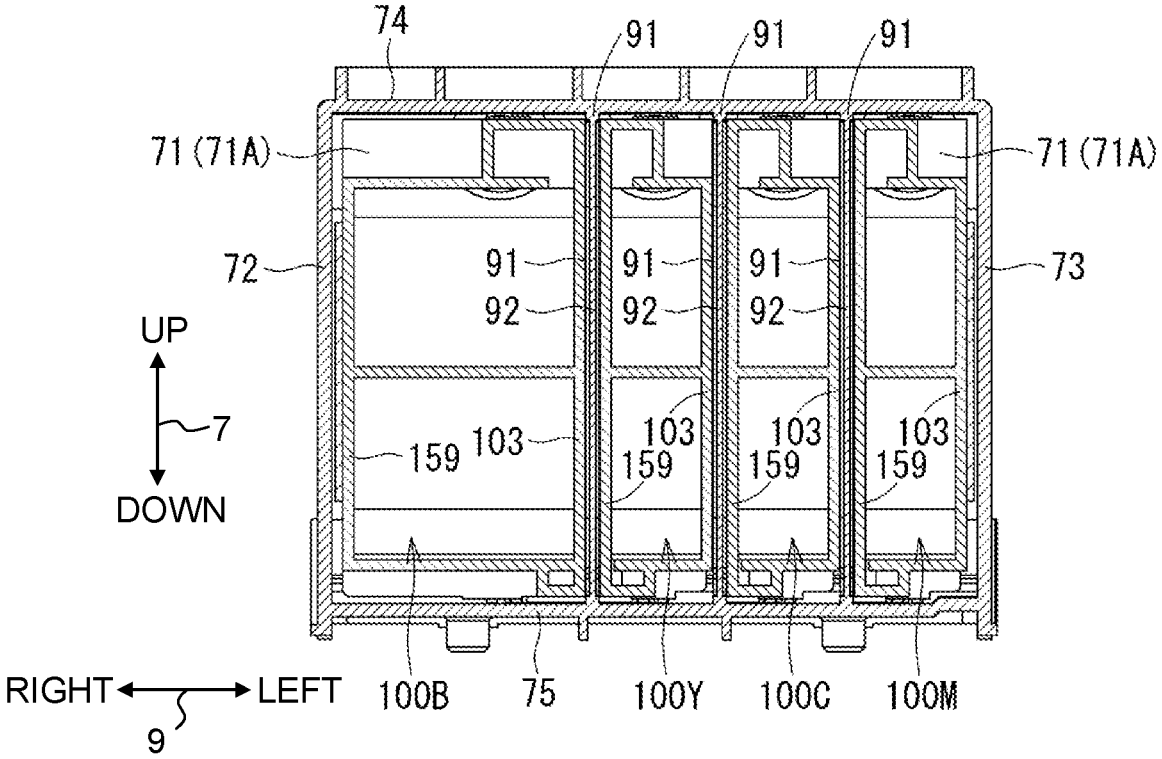
FIG. 14B is a cross-sectional view taken along XIVB-XIVB in FIG. 7B.

As depicted in FIG. 12 and FIGS. 14A and 14B, the positioning walls 91 are formed in a rear surface 91A of the front wall 71. Namely, each positioning wall 91 is disposed in a position corresponding to a front section of the ink tank 100 held by the binder 120. The positioning wall 91 protrudes from the rear surface 91A. The positioning wall 91 extends from an upper end to a lower end of the rear surface 91A. Namely, the positioning wall 91 is a protrusion protruding from the binder 120.

The position of the positioning wall 91 in the left-right direction 9 is between two adjacent ink tanks 100 in the left-right direction 9. Namely, the positioning walls 91 are disposed, in the left-right direction 9, between the ink tank 100B and the ink tank 100Y, between the ink tank 100Y and the ink tank 100C, and between the ink tank 100C and the ink tank 100M.

In a state that the ink tank 100 is held by the binder 120, a left surface of the positioning wall 91 positioned between the two adjacent ink tanks 100 is in contact with a right surface (an example of an outer side surface of the two side surfaces) of the right wall 159 of an ink tank 100, of the two adjacent ink tanks 100, positioned on the left side. In that state, a right surface of the positioning wall 91 positioned between the two adjacent ink tanks 100 is in contact with a left surface (an example of the outer side surface of the two side surfaces) of the left wall 103 of an ink tank 100, of the two adjacent ink tanks 100, positioned on the right side. Accordingly, the ink tanks 100 are positioned while leaving gaps or intervals in the left-right direction 9.

In the state that the ink tank 100 is held by the binder 120, the left surface of the positioning wall 91 positioned between the two adjacent ink tanks 100 has no contact with a right surface (an example of the outer side surface of the two side surfaces) of the film 142 of the ink tank 100, of the two adjacent ink tanks 100, positioned on the left side. Further, in the above state, a right surface of the positioning wall 91 positioned between the two adjacent ink tanks 100 has no contact with a left surface (an example of the outer side surface of the two side surfaces) of the film 143 of an ink tank 100, of the two adjacent ink tanks 100, positioned on the right side.

As described above, the positioning wall 91 is in contact with portions, of the side surfaces of the two adjacent ink tanks 100, formed from resin.

As depicted in FIG. 12, the partition wall 92 extends rearward from each positioning wall 91 to a rear end of the binder 120. Namely, the partition wall 92 is formed integrally with the positioning wall 91. The position of the partition wall 92 in the left-right direction 9 is between the two adjacent ink tanks 100 in the left-right direction 9. Namely, the partition walls 92 are disposed, in the left-right direction 9, between the ink tank 100B and the ink tank 100Y, between the ink tank 100Y and the ink tank 100C, and between the ink tank 100C and the ink tank 100M. An upper end of the partition wall 92 is connected to the upper wall 74. A lower end of the partition wall 92 is connected to the lower wall 75.

The thickness of the partition wall 92 in the left-right direction 9 is smaller than the thickness of the positioning wall 91 in the left-right direction 9. The partition wall 92 extends rearward from a center of the positioning wall 91 in the left-right direction 9. This allows each partition wall 92 to be disposed while leaving a gap between itself and the corresponding ink tank 100 in the left-right direction 9.

Figure 13:
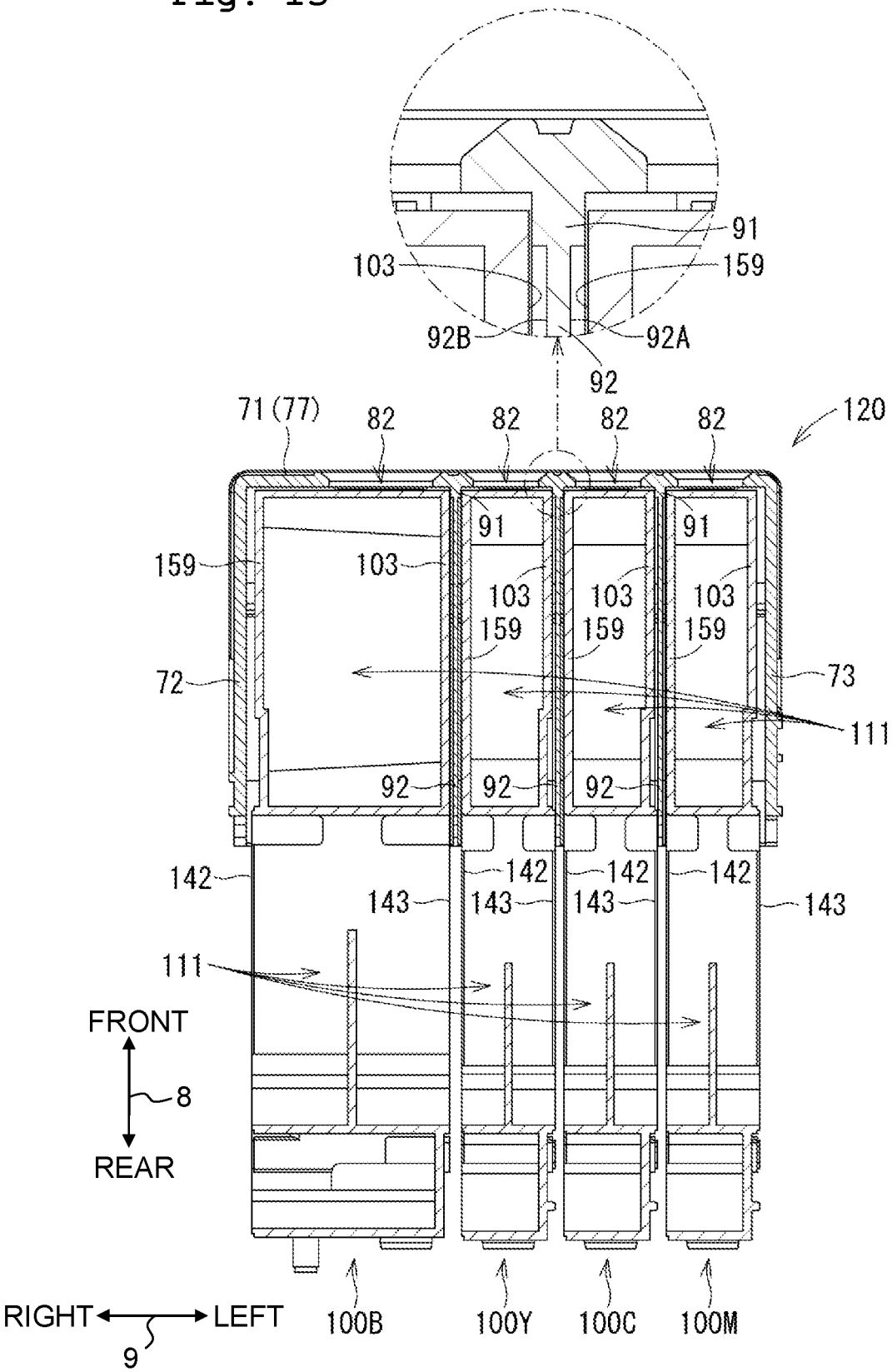
FIG. 13 is a cross-sectional view taken along XIII-XIII in FIG. 7A.

As depicted in FIG. 13, in a state that the ink tank 100 is held by the binder 120, a rear end of a left surface 92A (an example of a third surface) of the partition wall 92 positioned between the two adjacent ink tanks 100 faces the right surface of the film 142 of the ink tank 100, of the two adjacent ink tanks 100, positioned on the left side. In that state, a portion, of the left surface 92A of the partition wall 92 positioned between the two adjacent ink tanks 100, other than the rear end faces the right surface of the right wall 159 of the ink tank 100, of the two adjacent ink tanks 100, positioned on the left side.

As depicted in FIG. 13, in a state that the ink tank 100 is held by the binder 120, a rear end of a right surface 92B (an example of a fourth surface) of the partition wall 92 positioned between two adjacent ink tanks 100 faces the left surface of the film 143 of the ink tank 100, of the two adjacent ink tanks 100, positioned on the right side. In that state, a portion, of the right surface 92B of the partition wall 92 positioned between the two adjacent ink tanks 100, other than the rear end faces the left surface of the left wall 103 of the ink tank 100, of the two adjacent ink tanks 100, positioned on the right side.

As described above, the partition wall 92 is disposed between the two adjacent ink tanks 100 such that the partition wall 92 has no contact with the two side surfaces of the ink tanks 100.

As depicted in FIG. 8, openings 79 are formed in a rear section of the upper wall 74. The openings 79 respectively correspond to the four ink tanks 100B, 100Y, 100C, 100M. In other words, in the present embodiment, four of the openings 79 are formed. Each of the openings 79 is formed in a position corresponding to the protrusion 108 (refer to FIGS. 4A to 6) of each of the ink tanks 100, in a state that each of the ink tanks 100 has been inserted into the internal space 127.

Openings 80 are formed in a rear section of the lower wall 75. The openings 80 respectively correspond to the four ink tanks 100B, 100Y, 100C, 100M. In other words, in the present embodiment, four of the openings 80 are formed. Each of the openings 80 is formed in a position corresponding to the protrusion 109 (refer to FIG. 6) of each of the ink tanks 100, in a state that each of the ink tanks 100 has been inserted into the internal space 127.

Openings 68 are formed in the upper wall 74. Each of the openings 68 extends frontward from each of the openings 79. In other words, in the present embodiment, four of the openings 68 are formed. Each of the openings 68 is formed in a position corresponding to the protrusion 130 (see FIG. 6) of each of the ink tanks 100, in a state that each of the ink tanks 100 has been inserted into the internal space 127.

Openings 69 are formed in the lower wall 75. The openings 69 respectively correspond to the four ink tanks 100B, 100Y, 100C, 100M. In other words, in the present embodiment, four of the openings 69 are formed. In FIG. 8B, only the opening 69 corresponding to the ink tank 100B is depicted, and any other openings 69 are hidden by the partition walls 92. The four openings 69 are each formed more frontward than the four openings 80. Each of the openings 69 extends in the front-rear direction 8. Each of the openings 69 is formed in a position corresponding to the protrusion 133 (refer to FIG. 6) of each of the ink tanks 100, in a state that each of the ink tanks 100 has been inserted into the internal space 127.

In a process of each ink tank 100 being inserted into the internal space 127, the protrusion 108 is pressed by abutting on a surface 74A of the upper wall 74 on a side of the internal space 127 and thereby bends downwardly. Moreover, the protrusion 109 is pressed by abutting on a surface 75A of the lower wall 75 on the side of the internal space 127 and thereby bends upwardly. When the ink tank 100 is further inserted, the protrusion 108 is inserted into the opening 79 and the protrusion 109 is inserted into the opening 80. As a result, bending of the protrusions 108, 109 is released.

In this state, the protrusion 108 engages with the opening 79 and the protrusion 109 engages with the opening 80.

In an engaged state of the protrusion 108 and the opening 79, if a user attempts to move the ink tank 100 frontward with respect to the binder 120, the protrusion 108 abuts on a front edge surface 79A demarcating a front end of the opening 79. As a result, frontward movement of the ink tank 100 with respect to the binder 120 is restricted. Moreover, in an engaged state of the protrusion 108 and the opening 79, if the user attempts to move the ink tank 100 rearward with respect to the binder 120, the protrusion 108 abuts on a rear edge surface 79B demarcating a rear end of the opening 79. As a result, rearward movement of the ink tank 100 with respect to the binder 120 is restricted.

In an engaged state of the protrusion 109 and the opening 80, if the user attempts to move the ink tank 100 frontward with respect to the binder 120, the protrusion 109 abuts on a front edge surface 80A demarcating a front end of the opening 80. As a result, frontward movement of the ink tank 100 with respect to the binder 120 is restricted. Moreover, in an engaged state of the protrusion 109 and the opening 80, if the user attempts to move the ink tank 100 rearward with respect to the binder 120, the protrusion 109 abuts on a rear edge surface 80B demarcating a rear end of the opening 80. As a result, rearward movement of the ink tank 100 with respect to the binder 120 is restricted.

As described above, by the protrusion 108 abutting on an edge surface of the opening 79 and the protrusion 109 abutting on an edge surface of the opening 80, the ink tank 100 is positioned in the front-rear direction 8.

Figure 10:
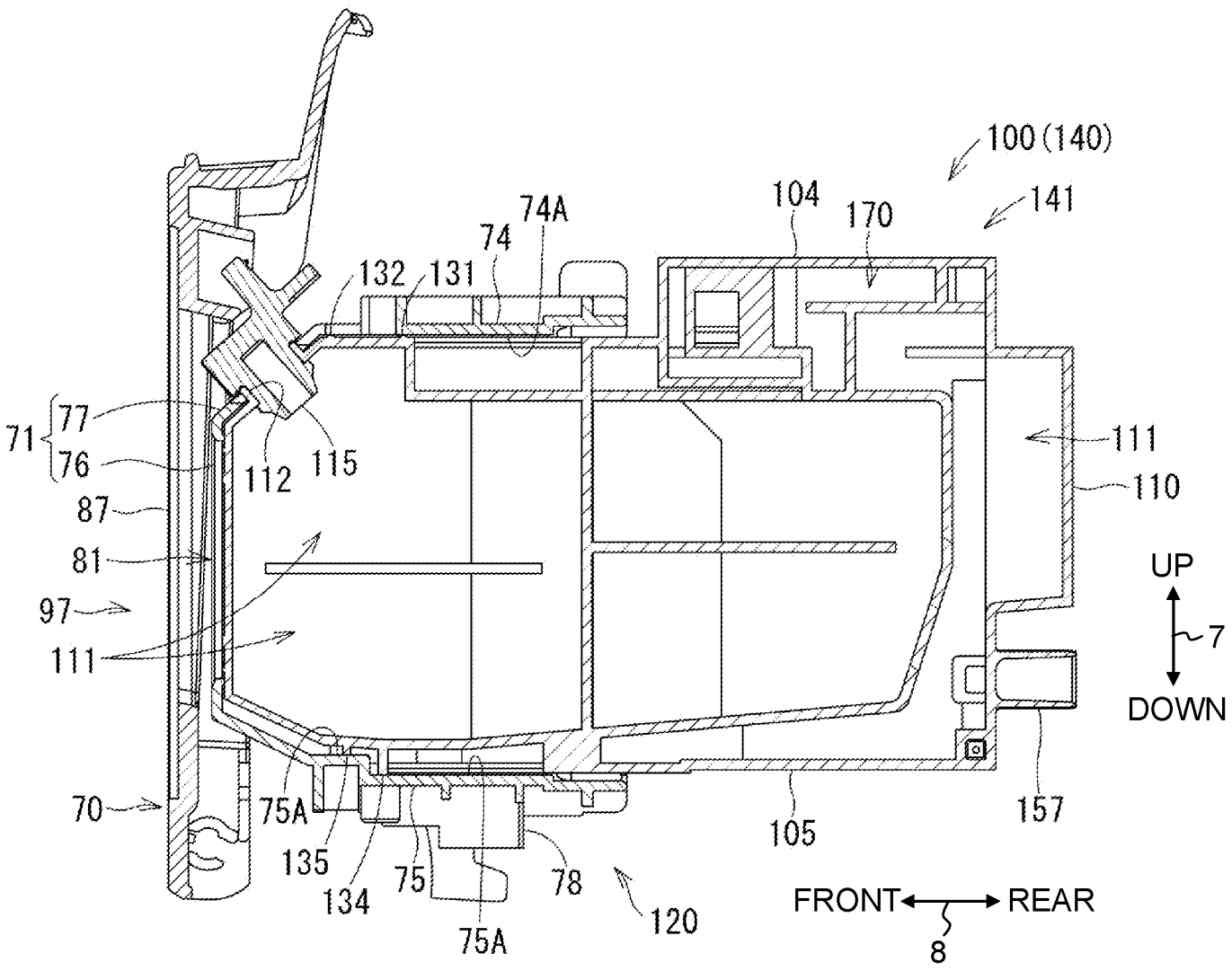
FIG. 10 is a longitudinal cross-sectional view of the ink tank and the binder and the cover.

Moreover, in a state that the protrusion 108 and opening 79 are engaged and the protrusion 109 and opening 80 are engaged, as depicted in FIG. 10, the protrusions 131, 132 abut on the surface 74A of the upper wall 74 on the side of the internal space 127, and the protrusions 134, 135 abut on the surface 75A of the lower wall 75 on the side of the internal space 127. As a result, the ink tank 100 is positioned in the up-down direction 7. There may be a gap, which substantially corresponds to tolerance, between the protrusions 131, 132 and the surface 74A.

Figure 11A:
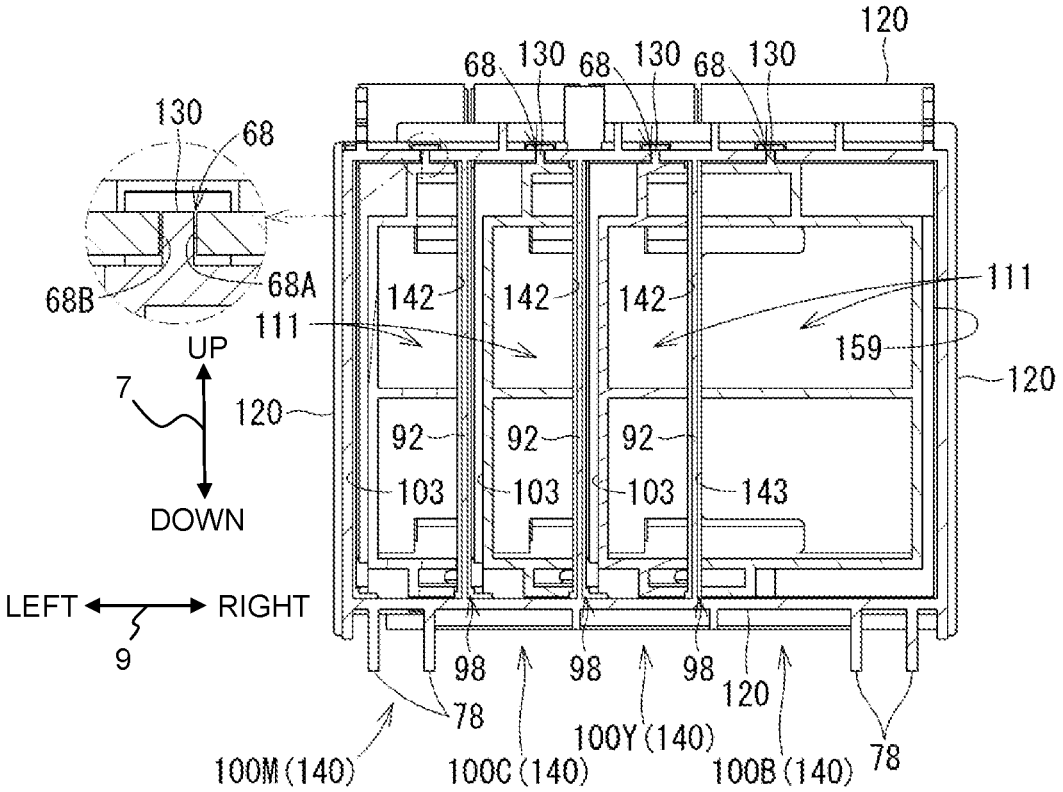
FIG. 11A is a cross-sectional view taken along XIA-XIA in FIG. 7B.

Moreover, in a state that the protrusion 108 and opening 79 are engaged and the protrusion 109 and opening 80 are engaged, the protrusion 130 is inserted into the opening 68, as depicted in FIG. 11A. In an inserted state of the protrusion 130 into the opening 68, if the user attempts to move the ink tank 100 rightward with respect to the binder 120, the protrusion 130 abuts on a right edge surface 68A demarcating a right end of the opening 68. Moreover, in an inserted state of the protrusion 130 into the opening 68, if the user attempts to move the ink tank 100 leftward with respect to the binder 120, the protrusion 130 abuts on a left edge surface 68B demarcating a left end of the opening 68.

Figure 11B:
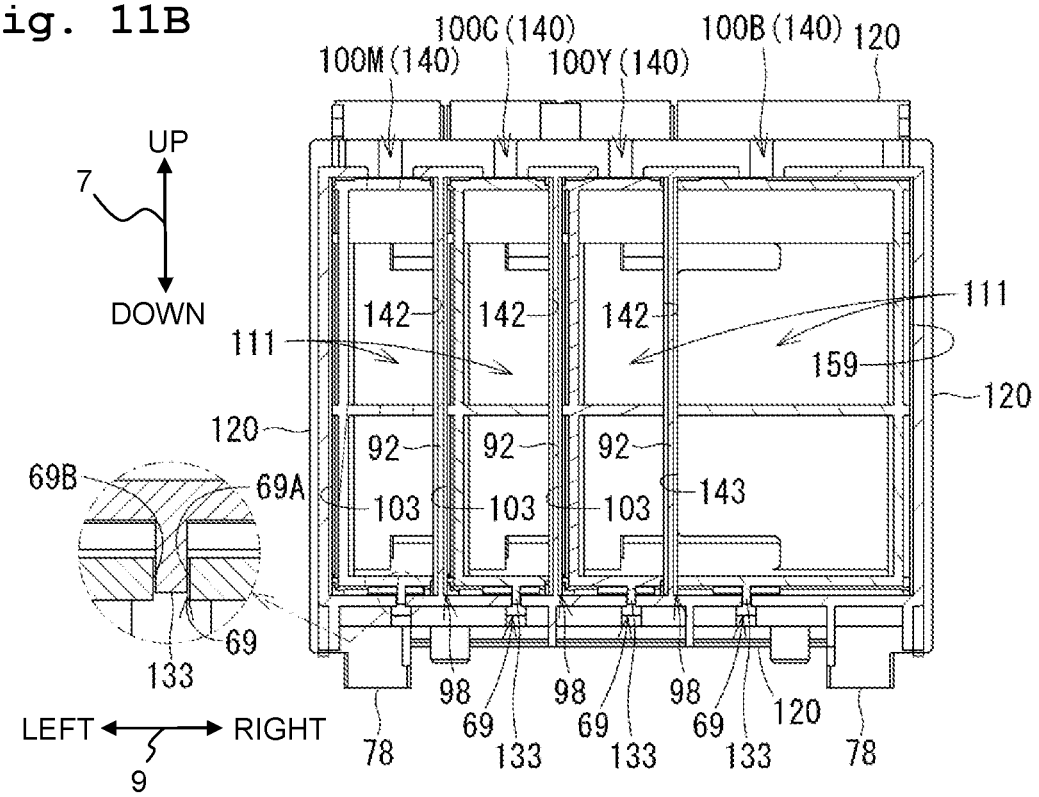
FIG. 11B is a cross-sectional view taken along XIB-XIB in FIG. 7B.

Moreover, in a state that the protrusion 108 and opening 79 are engaged and the protrusion 109 and opening 80 are engaged, the protrusion 133 is inserted into the opening 69, as depicted in FIG. 11B. In an inserted state of the protrusion 133 into the opening 69, if the user attempts to move the ink tank 100 rightward with respect to the binder 120, the protrusion 133 abuts on a right edge surface 69A demarcating a right end of the opening 69. Moreover, in an inserted state of the protrusion 133 into the opening 69, if the user attempts to move the ink tank 100 leftward with respect to the binder 120, the protrusion 133 abuts on a left edge surface 69B demarcating a left end of the opening 69.

As described above, the ink tank 100 is positioned in the left-right direction 9 by the protrusion 130 abutting on the edge surfaces of the opening 68 and the protrusion 133 abutting on the edge surfaces of the opening 69. Here, as described above, the ink tank 100 is positioned in the left-right direction 9 by the right wall 159 and the left wall 103 abutting on the positioning wall 91. Namely, in the present embodiment, the front end of the ink tank 100 is positioned in the left-right direction 9 by the positioning wall 91, and a rear section of the front end of the ink tank 100 is positioned in the left-right direction 9 by the edge surfaces of the openings 68 and 69.

As depicted in FIGS. 11A and 11B, in a positioned state in the left-right direction 9, a gap 98 is formed between adjacent ink tanks 100.

As described above, the binder 120 holds the four ink tanks 100B, 100Y, 100C, 100M in a state of being aligned in the left-right direction 9, as depicted in FIGS. 7A and 7B. Note that an arrangement order of the ink tanks 100 is, in order from the right, the ink tank 100B, the ink tank 100Y, the ink tank 100C, and the ink tank 100M.

In a state of the binder 120 holding the ink tank 100, the front wall 71 covers the front wall 101 of the ink tank 100, the upper wall 74 covers a front section of the upper wall 104 of the ink tank 100, and the lower wall 75 covers a front section of the lower wall 105 of the ink tank 100.

Moreover, in a state of the binder 120 holding the ink tank 100, the right wall 72 covers a front section of a right surface (the right wall 159) of the ink tank 100B disposed most rightward of the four ink tanks 100, and the left wall 73 covers a front section of a left surface (the left wall 103) of the ink tank 100M disposed most leftward of the four ink tanks 100.

As described above, the binder 120 in a state of holding the ink tank 100 covers the front section of the ink tank 100.

As depicted in FIG. 8A, openings 81 are formed in the upright wall 76 of the front wall 71 of the binder 120. The openings 81 are formed while leaving gaps therebetween in the left-right direction 9. The openings 81 respectively correspond to the four ink tanks 100B, 100Y, 100C, 100M. In other words, in the present embodiment, four of the openings 81 are formed. In the present embodiment, a shape of each of the openings 81 is a rectangle, but may be other than a rectangle.

As depicted in FIG. 7A, in a state of the binder 120 holding each of the ink tanks 100, the upright wall 102 of the front wall 101 of each of the ink tanks 100 is exposed to outside of the binder 120 via the opening 81. Moreover, as depicted in FIG. 1A, in a state of the binder 120 holding each of the ink tanks 100 and a state of the cover 70 being in the closed position, the upright wall 102 of each of the ink tanks 100 is exposed to outside of the printer unit 11 via the opening 81 of the binder 120 and the opening 97 of the cover 70. This allows the user to confirm a remaining amount of ink stored in each ink tank 100, from the outside of the printer unit 11.

As depicted in FIGS. 8A and 8B, openings 82 are formed in the inclined wall 77 of the front wall 71 of the binder 120. The openings 82 are formed while leaving gaps in the left-right direction 9. The openings 82 respectively correspond to the four ink tanks 100B, 100Y, 100C, 100M. In other words, in the present embodiment, four of the openings 82 are formed. In the present embodiment, a shape of each of the openings 82 is a circle, but may be other than a circle.

As depicted in FIG. 7A, in a state of the binder 120 holding each of the ink tanks 100, the inlet 112 of each of the ink tanks 100 is exposed to outside of the binder 120 via the opening 82.

As depicted in FIGS. 8A and 8B, a cap attachment section 155, to which a later-mentioned cap 113 is attached, is formed in a front section of the upper wall 74 of the binder 120.

<Cap 113>

As depicted in FIGS. 7A and 7B, the ink tank 100 includes caps 113B, 113Y, 113C, 113M (these are sometimes collectively described as "cap 113"). The ink tank 100 includes the four caps 113B, 113Y, 113C, 113M corresponding to the four inlets 112B, 112Y, 112C, 112M of the ink tank 100.

Each of the caps 113 is molded by a material capable of elastic deformation such as rubber or elastomer. Each of the caps 113 includes a cap section 115, an elastic deformation section 116, and an attaching section 117. Note that structure of each of the caps 113 is not limited to structure described below.

The cap section 115 has an appearance substantially in a shape of disc.

The elastic deformation section 116 is strip shaped. One end of the elastic deformation section 116 is connected to the cap section 115. The other end of the elastic deformation section 116 is connected to the attaching section 117. The elastic deformation section 116, in a state of not being applied with a force from outside, is in a state of extending roughly straight, as depicted in FIGS. 7A and 7B.

The attaching section 117 is capable of being fitted to the cap attachment section 155. This allows the cap 113 to be attached to the binder 120.

The cap 113 seals the inlet 112 in a liquid-tight manner by the cap section 115 closely contacting a wall surface demarcating a peripheral edge of the inlet 112. In that situation, although not illustrated in the drawings, the elastic deformation section 116 is curved in a circular arc shape.

As depicted in FIGS. 7A and 7B, the inlet 112 is opened by separating the cap section 115 from the inlet 112. This allows the ink to be filled into the ink chamber 111 through the inlet 112. In a state of the cap 113 being positioned in the separated position, the elastic deformation section 116 undergoes elastic recovery to extend roughly straight.

Function and Effect of the Embodiment

In the present embodiment, the positioning wall 91 is positioned between two adjacent ink tanks 100, as depicted in FIG. 13. Further, the positioning wall 91 is in contact with the outer side surfaces (the right surface of the right wall 159 of the left ink tank 100 and the left surface of the left wall 103 of the right ink tank 100) of the side surfaces facing each other of the two adjacent ink tanks 100. This allows the two adjacent ink tanks 100 to be held while leaving a gap formed by the positioning wall 91.

Although the positioning wall 91 is in contact with the right wall 159 and the left wall 103 that are formed from resin, the positioning wall 91 has no contact with the films 142 and 143. This reduces the possibility that the films 142 and 143 are damaged by the contact with the positioning wall 91.

If the positioning walls 91 are formed as protrusions protruding from the right surface of the right wall 159 and the left surface of the left wall 103 of the ink tank 100, a predefined gap is required to be provided between the protrusion formed in the right surface of the ink tank 100 and the film 142, and a predefined gap is required to be provided between the protrusion formed in the left surface of the ink tank 100 and the film 143. Those predefined gaps make the ratio of the right wall 159 in the right surface of the ink tank 100 and the ratio of the left wall 103 in the left surface of the ink tank 100 larger. Then, the ratio of the film 142 in the right surface of the ink tank 100 and the ratio of the film 143 in the left surface of the ink tank 100 are smaller. As a result, the amount of ink stored in the ink chamber 111 is smaller.

In the present embodiment, each positioning wall 91 is formed in the binder 120. This allows the gap between the protrusion formed in the right surface of the ink tank 100 and the film 142 to be smaller than the predefined gap, and allows the gap between the protrusion formed in the left surface of the ink tank 100 and the film 143 to be smaller than the predefined gap. Thus, the ratio of the film 142 in the right surface of the ink tank 100 is allowed to be large and the ratio of the film 143 in the left surface of the ink tank 100 is allowed to be large. As a result, the amount of ink stored in the ink chamber 111 can be increased without making the volume of the ink tank 100 large.

When there is a gap between two adjacent ink tanks 100, light may enter the ink tank 100 through the gap. The light entering the ink tank 100 may change, for example, the quality of ink stored in the ink chamber 111. In the present embodiment, the partition wall 92 is disposed between the two adjacent ink tanks 100. This reduces light from entering the ink tank 100.

The partition wall 92 is disposed in a position having no contact with the side surfaces facing each other (the right surface of the right wall 159 and the right surface of the film 142 of the left ink tank 100, and the left surface of the left wall 103 and the left surface of the film 143 of the right ink tank 100) of the two adjacent ink tanks 100. This can reduce the possibility that the two side surfaces are damaged by contacting with the partition wall 92.

In the present embodiment, the partition wall 92 extends from the positioning wall 91. This allows the partition wall 92 and the positioning wall 91 to be molded integrally.

Although the light from the outside is highly likely to enter the ink tank 100 through an end (front ends of the ink tank 100 and the binder 120) accessible to the ink tank 100 from the outside of the casing 14, in the present embodiment, the positioning wall 91 is disposed at the end. Thus, the positioning wall 91 reduces light that may otherwise enter the ink tank 100 from the outside.

In the present embodiment, the positioning wall 91 and the partition wall 92 reduce light coming from the outside and reaching the optical sensor 168 and the protrusion 167. This reduces the possibility of false detection of the optical sensor 168.

Modified Embodiments

In the above embodiment, the positioning wall 91 is disposed to extend from the upper end to the lower end of the rear surface 91A (see FIG. 12) of the front wall 71. The positioning wall 91, however, may be disposed at any other position, provided that the positioning wall 91 has no contact with the films 142 and 143 in a state that the ink tank 100 is held by the binder 120.

For example, the positioning wall 91 may be formed only at a center of the rear surface 91A in the up-down direction 7, or the positioning walls 91 may be formed only at the upper end and the lower end of the rear surface 91A.

The positioning wall 91 may be formed in any other surface than the rear surface 91A of the front wall 71. For example, the positioning wall(s) 91 may be formed in the surface 74A of the upper wall 74 on the side of the internal space 127 (see FIG. 10) and/or the surface 75A of the lower wall 75 on the side of the internal space 127 (see FIG. 10). Namely, the positioning wall 91 may be disposed in any position except for the front section of the frame 141 in a state that the ink tank 100 and the binder 120 are installed on the inside of the casing 14. For example, the positioning wall 91 may be disposed in the rear section of the frame 141.

In the above embodiment, the partition wall 92 is formed integrally with the positioning wall 91. The partition wall 92, however, may be formed independently of the positioning wall 91. Namely, the partition wall 92 may be disposed while leaving a gap between itself and the positioning wall 91.

In the above embodiment, the partition wall 92 extends from a front end to a rear end of the internal space 127 of the binder 120 and extends from an upper end to a lower end of the internal space 127 of the binder 120. The arrangement range of the partition wall 92 is not limited to the above. For example, the partition wall 92 may be disposed only at the front or rear section in the front-rear direction 8 in the internal space 127 of the binder 120, or may be disposed only at the upper or lower section in the up-down direction 7 in the internal space 127 of the binder 120.

In the above embodiment, the binder 120 includes the positioning walls 91 and the partition walls 92. The binder 120, however, may not include the partition walls 92. In that case, the internal space 127 of the binder 120 is divided into a plurality only by the positioning walls 91.

In the above embodiment, the positioning of the ink tank 100 in the left-right direction 9 is made by using the positioning wall 91 and the protrusions 130, 133. The positioning of the ink tank 100 in the left-right direction 9, however, may be made only by the positioning wall 91.

In the above embodiment, as depicted in FIGS. 4A, 4B and FIG. 5, the right wall 159 and the left wall 103 of the ink tank 100 are provided in the front section of the frame 141. The right wall 159 and the left wall 103, however, may be provided in any other section than the front section of the frame 141. For example, the right wall 159 and the left wall 103 may be provided in the rear section of the frame 141. Or, for example, the right wall 159 may be provided in the front section of the frame 141 and the left wall 103 may be provided in the rear section of the frame 141. The positions of the films 142, 143 and the position of the positioning wall 91 are determined based on the positions of the right wall 159 and the left wall 103.

In the above embodiment, the positioning walls 91 are formed in the binder 120. The positioning walls 91, however, may be formed in the ink tanks 100.

Figure 15:
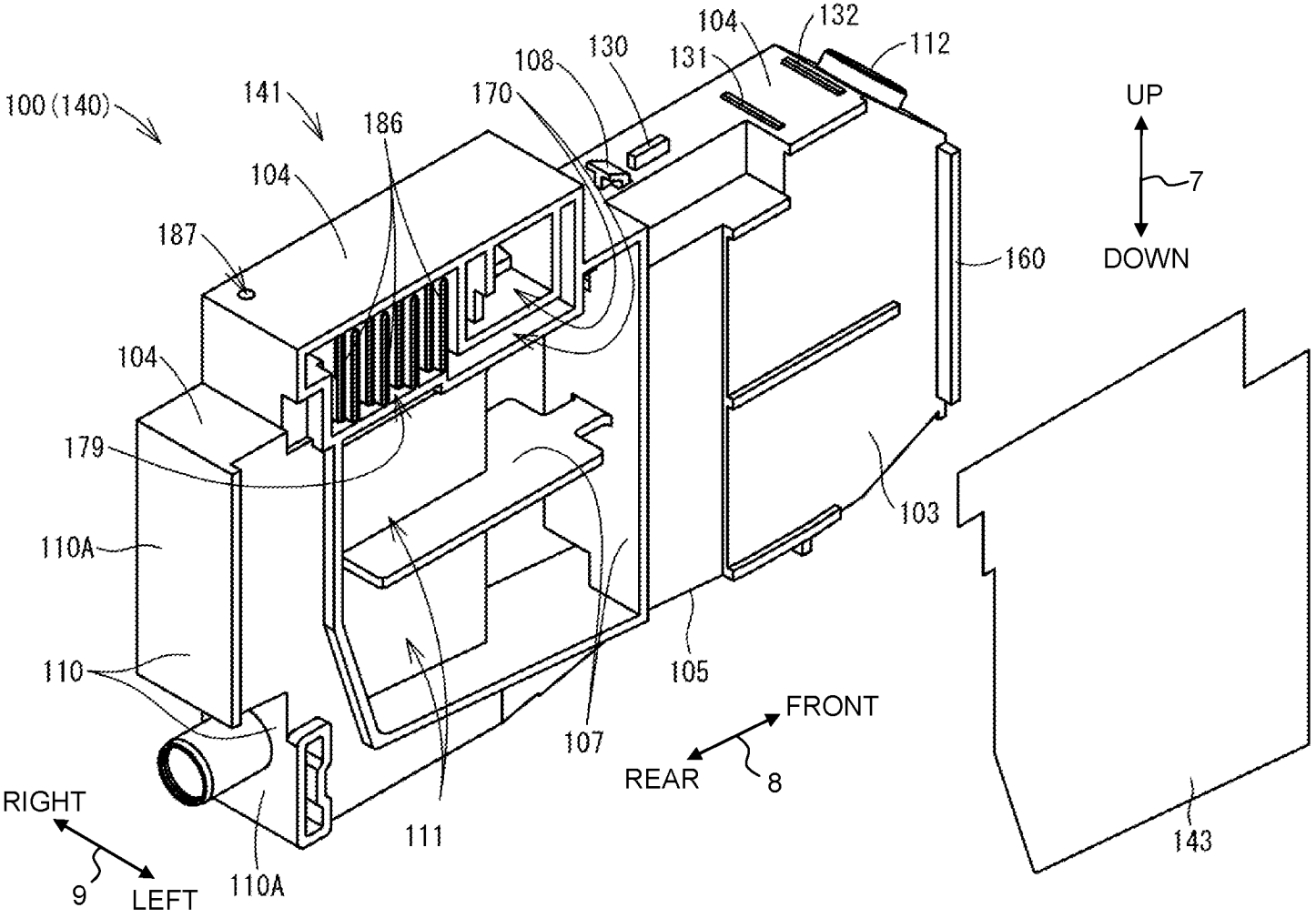
FIG. 15 is a rear perspective view of an ink tank according to a modified embodiment.
Figure 16:
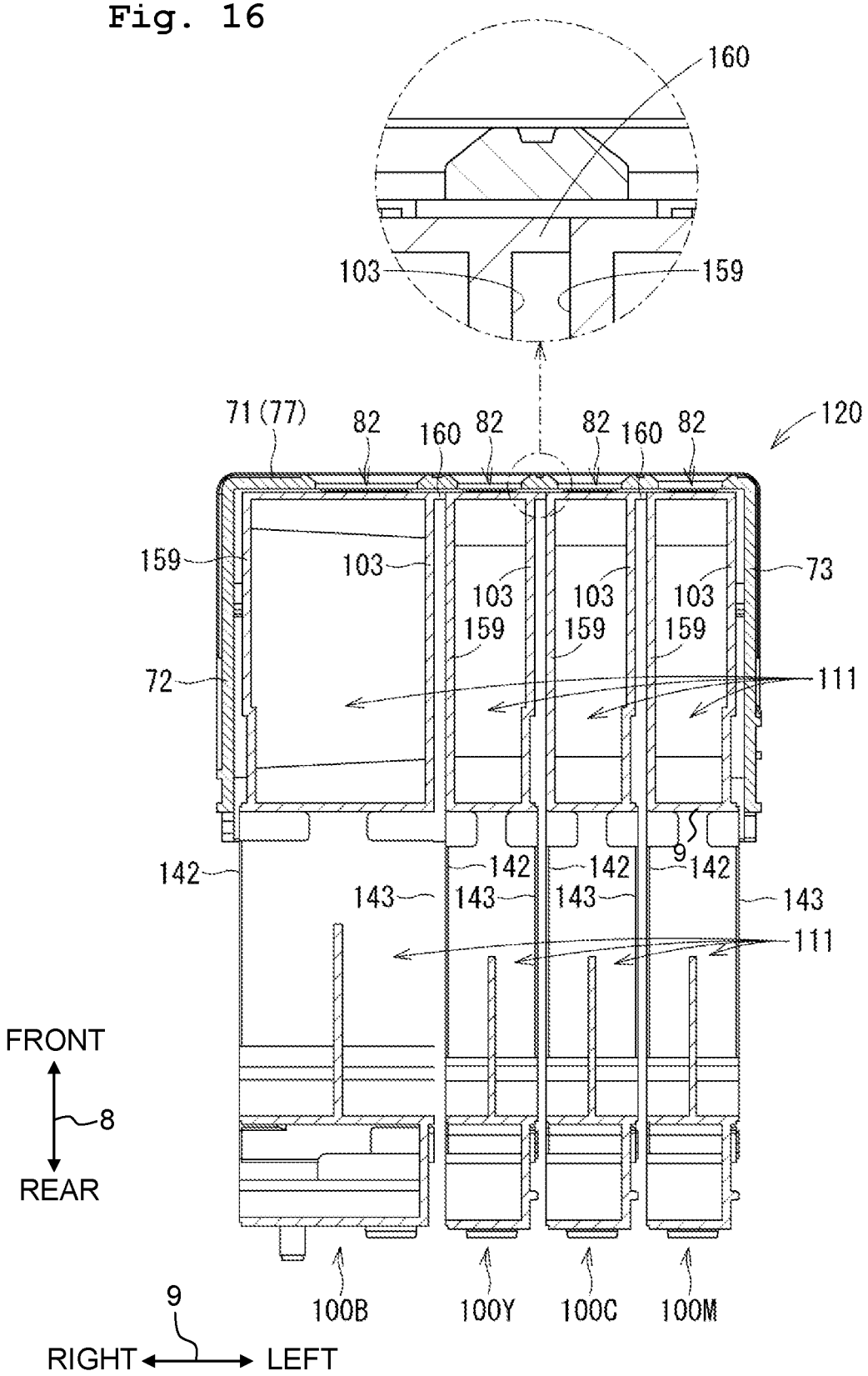
FIG. 16 is a cross-sectional view, of a binder holding ink tanks according to the modified embodiment, corresponding to the cross section taken along XIII-XIII in FIG. 7A.

For example, as depicted in FIG. 15, the positioning wall 91 may be a rib 160 protruding leftward from a front end of the left wall 103 of the ink tank 100. In that case, as depicted in FIG. 16, a protruding tip of the rib 160 of a predefined ink tank 100 is in contact with the right wall 159 of the ink tank 100 disposed on the left side of the predefined ink tank 100. Accordingly, the ink tanks 100 are arranged in the left-right direction 9. The position of the rib 160 is not limited to the front end of the left wall 103. For example, the rib 160 may be formed in a rear end of the left wall 103. Or, for example, the rib 160 may protrude rightward from the right wall 159.

In the configuration in which the rib 160 is formed in the ink tank 100, each partition wall 92 is disposed in the binder 120 at a position having no contact with the rib 160 in a process of inserting the ink tank 100 into the internal space 127 of the binder 120. For example, when the ribs 160 are formed in the upper end and the lower end of the ink tank 100, the partition wall 92 is formed in a center of the binder 120 in the up-down direction 7. In the configuration in which the rib 160 is formed in the ink tank 100, the binder 120 may include no partition wall 92.

In the above embodiment, the protrusion 167 is disposed in the lower section of the rear wall 110. The protrusion 167, however, may be disposed in any other section than the lower section of the rear wall 110. For example, the protrusion 167 may be disposed in a lower section of the front wall 101. In that case, it is needless to say that the arrangement position of the optical sensor 168 depends on the arrangement position of the protrusion 167.

In the above embodiment, the optical sensor 168 and the protrusion 167 detect a height of a liquid surface of ink stored in the ink chamber 111. The present teaching may adopt any other detection means than the optical sensor 168 and the protrusion 167.

For example, a prism may be disposed in the ink chamber 111. In that configuration, the optical sensor 168 may detect a receiving state of light irradiating the prism to obtain a height of a liquid surface of ink stored in the ink chamber 111. Further, for example, a rotating member that rotates depending on a height of a liquid surface of ink may be disposed in the ink chamber 111. In that configuration, the optical sensor 168 may detect a receiving state of light irradiating the rotating member to obtain the height of the liquid surface of ink stored in the ink chamber 111. Further, for example, two electrodes, of which lower ends have different heights, may be disposed in the ink chamber 111. In that configuration, a height of a liquid surface of ink stored in the ink chamber 111 may be detected based on whether current flows in a state that a distance between the two electrodes is filled with ink.

In the above embodiment, ink was described as an example of liquid. However, the present teaching is not limited to this. That is, a pretreatment liquid discharged onto a recording sheet prior to the ink during printing, water sprayed in a vicinity of the nozzle 40 of the recording head 39 for preventing drying of the nozzle 40 of the recording head 39, and the like, are also examples of liquid.

What is claimed is:

1. A supply apparatus, comprising:

tanks each having a casing, the casing including a frame and films having rigidity lower than that of the frame, the frame having a front wall, a rear wall, an upper wall, a lower wall, a left wall and a right wall, one of the films being welded to at least a part of the left wall, another of the films being welded to at least a part of the right wall, the casing having a liquid storage chamber at least a part of which is defined by the films and an inlet through which liquid is supplied to the liquid storage chamber;

a binder configured to hold the tanks in a state of being arranged in a left-right direction; and a positioning part configured to position two tanks at an interval in the left-right direction, the two tanks being included in the tanks and disposed adjacent to each other in the left-right direction, wherein the positioning part is disposed between the two tanks in the left-right direction and in contact with the frame of each of the two tanks.

2. The supply apparatus according to claim 1, wherein the positioning part is formed in the binder.

3. The supply apparatus according to claim 2, further comprising a partition wall disposed between the two tanks and having no contact with the two tanks.

4. The supply apparatus according to claim 3, wherein the partition wall extends from the positioning part.

* * * * *